US005650770A

United States Patent [19]

Schlager et al.

[11] Patent Number: 5,650,770

[45] Date of Patent: Jul. 22, 1997

[54] SELF-LOCATING REMOTE MONITORING SYSTEMS

[76] Inventors: Dan Schlager, 16 Barn Rd., Mill Valley, Calif. 94941; William B. Baringer, 6111 Westover Dr., Oakland, Calif. 94611

[21] Appl. No.: 547,026

[22] Filed: Oct. 23, 1995

Related U.S. Application Data

[63] Continuation-in-part of Ser. No. 330,901, Oct. 27, 1994, Pat. No. 5,461,365.

[51] Int. Cl.[6] ..... G08B 25/10

[52] U.S. Cl. ..... 340/573; 340/539; 340/540; 340/574; 340/990; 342/126; 342/357; 342/450

[58] Field of Search ..... 340/539, 573, 340/990, 989, 984, 574, 540; 342/357, 450, 457, 126

[56] References Cited

U.S. PATENT DOCUMENTS

| | | | |
|---|---|---|---|
| 3,784,842 | 1/1974 | Kremer | 340/573 |
| 4,598,272 | 7/1986 | Cox | 340/539 |
| 4,656,463 | 4/1987 | Anders et al. | 340/572 |
| 4,665,385 | 5/1987 | Henderson | 340/539 |
| 4,675,656 | 6/1987 | Narcisse | 340/539 |
| 4,777,478 | 10/1988 | Hirsch et al. | 340/573 |
| 4,785,291 | 11/1988 | Hawthorne | 340/573 |
| 4,819,860 | 4/1989 | Hargrove et al. | 228/668 |
| 4,899,135 | 2/1990 | Ghahariiran | 340/573 |
| 4,952,928 | 8/1990 | Carroll et al. | 340/825.54 |
| 5,025,247 | 6/1991 | Banks | 340/573 |
| 5,043,702 | 8/1991 | Kuo | 340/539 |
| 5,043,736 | 8/1991 | Darnell et al. | 342/357 |
| 5,047,750 | 9/1991 | Hector | 340/573 |
| 5,086,391 | 2/1992 | Chambers | 364/413.02 |
| 5,115,223 | 5/1992 | Moody | 340/573 |
| 5,119,341 | 6/1992 | Youngberg | 367/5 |
| 5,202,829 | 4/1993 | Geier | 364/449 |
| 5,223,844 | 6/1993 | Mansell et al. | 342/357 |
| 5,225,842 | 7/1993 | Brown et al. | 342/357 |
| 5,301,368 | 4/1994 | Hirata | 455/78 |
| 5,311,197 | 5/1994 | Sorden et al. | 342/457 |
| 5,319,698 | 6/1994 | Glidewelle et al. | 340/539 |
| 5,334,974 | 8/1994 | Simms et al. | 340/990 |
| 5,345,244 | 9/1994 | Gildea et al. | 342/357 |
| 5,355,140 | 10/1994 | Slavin et al. | 342/386 |
| 5,365,450 | 11/1994 | Schuchman et al. | 364/449 |
| 5,367,306 | 11/1994 | Hollon et al. | 342/386 |
| 5,379,224 | 1/1995 | Brown et al. | 364/449 |
| 5,381,129 | 1/1995 | Boardman | 340/573 |
| 5,408,238 | 4/1995 | Smith | 342/357 |
| 5,418,537 | 5/1995 | Bird | 342/357 |
| 5,420,592 | 5/1995 | Johnson | 342/357 |
| 5,422,814 | 6/1995 | Sprague et al. | 364/449 |
| 5,422,816 | 6/1995 | Sprague et al. | 364/449 |
| 5,438,337 | 8/1995 | Aguado | 342/357 |
| 5,440,491 | 8/1995 | Kawano et al. | 364/443 |
| 5,450,344 | 9/1995 | Woo et al. | 364/449 |
| 5,461,390 | 10/1995 | Hoshen | 342/419 |

*Primary Examiner*—Glen Swann
*Attorney, Agent, or Firm*—Robert Buckley

[57] ABSTRACT

A personal alarm system includes a monitoring base station and one or more remote sensing units in two-way radio communication. An electronic handshake between the base station and each remote unit is used to assure system reliability. The remote units transmit at selectable power levels. In the absence of an emergency, a remote unit transmits at a power-conserving low power level. Received field strength is measured to determine whether a remote unit has moved beyond a predetermined distance from the base station. If the distance is exceeded, the remote unit transmits at a higher power level. The remote unit includes sensors for common hazards including water immersion, smoke, excessive heat, excessive carbon monoxide concentration, and electrical shock. The base station periodically polls the remote units and displays the status of the environmental sensors. The system is useful in child monitoring, for use with invalids, and with employees involved in activities which expose them to environmental risk. Alternative embodiments include a panic button on the remote unit for summoning help, and an audible beacon on the remote unit which can be activated from the base station and useful for locating strayed children. In another embodiment, the remote unit includes a Global Positioning System receiver providing location information for display by the base station.

63 Claims, 14 Drawing Sheets

MESSAGE FORMAT: REMOTE TO BASE

MESSAGE FORMAT: BASE TO REMOTE

SELF-LOCATING REMOTE MONITORING SYSTEMS

CLAIM OF PRIORITY

This application is a continuation-in-part of, and claims priority from, U.S. patent application, Ser. No. 08/330,901, filed Oct. 27, 1994, entitled "Multi-Hazard Alarm System Using Selectable Power-Level Transmission and Localization," by the same inventors. The patent application is now U.S. Pat. No. 5,461,365, which issued on Oct. 24, 1995.

BACKGROUND OF THE INVENTION

1. Field of the Invention

This invention relates to personal alarm systems and in particular to such systems transmitting at a higher power level during emergencies.

2. Background Art

Personal alarm systems are well known in the art (see for example U.S. Pat. Nos. 4,777,478, 5,025,247, 5,115,223, 4,952,928, 4,819,860, 4,899,135, 5,047,750, 4,785,291, 5,043,702, and 5,086,391). These systems are used to maintain surveillance of children. They are used to monitor the safety of employees involved in dangerous work at remote locations. They are even used to find lost or stolen vehicles and strayed pets.

These systems use radio technology to link a remote transmitting unit with a base receiving and monitoring station. The remote unit is usually equipped with one or more hazard sensors and is worn or attached to the person or thing to be monitored. When a hazard is detected, the remote unit transmits to the receiving base station where an operator can take appropriate action in responding to the hazard.

The use of personal alarm systems to monitor the activities of children has become increasingly popular. A caretaker attaches a small remote unit, no larger than a personal pager, to an outer garment of a small child. If the child wanders off or is confronted with a detectable hazard, the caretaker is immediately notified and can come to the child's aid. In at least one interesting application, a remote unit includes a receiver and an audible alarm which can be activated by a small hand-held transmitter. The alarm is attached to a small child. If the child wanders away in a large crowd, such as in a department store, the caretaker actives the audible alarm which then emits a sequence of "beeps" useful in locating the child in the same way one finds a car at a parking lot through the use of an auto alarm system.

A number of novel features have been included in personal alarm systems. Hirsh et al., U.S. Pat. No. 4,777,478, provide for a panic button to be activated by the child, or an alarm to be given if someone attempts to remove the remote unit from the child's clothing. Banks, U.S. Pat. No. 5,025,247, teaches a base station which latches an alarm condition so that failure of the remote unit, once having given the alarm, will not cause the alarm to turn off before help is summoned. Moody, U.S. Pat. No. 5,115,223, teaches use of orbiting satellites and triangulation to limit the area of a search for a remote unit which has initiated an alarm. In U.S. Pat. No. 4,952,928 to Carroll et al., and in U.S. Pat. No. 4,819,860 to Hargrove et at., the apparatus provides for the remote monitoring of the vital signs of persons who are not confined to fixed locations.

Ghahariiran, U.S. Pat. No. 4,899,135, teaches a child monitoring device using radio or ultra-sonic frequency to give alarm if a child wanders out of range or falls into water.

Hawthorne, U.S. Pat. No. 4,785,291, teaches a distance monitor for child surveillance in which a unit worn by the child includes a radio transmitter. As the child moves out of range, the received field strength, of a signal transmitted by the child's unit, falls below a limit and an alarm is given.

Clinical experience in the emergency rooms of our hospitals has taught that a limited number of common hazards account for a majority of the preventable injuries and deaths among our toddler age children. These hazards include the child's wandering away from a safe or supervised area, water immersion, fire, smoke inhalation, carbon monoxide poisoning and electrical shock. Child monitoring devices, such as those described above, have been effective in reducing the number of injuries and deaths related to these common preventable hazards.

However, considering the importance of our children's safety, there remains room for improvement of these systems. One such area for improvement relates to increasing the useful life of a battery used to power the remote unit of these toddler telemetry systems, as they have come to be called.

The remote unit is typically battery operated and, in the event of an emergency, continued and reliable transmission for use in status reporting and direction finding is of paramount importance. In other words, once the hazard is detected and the alarm given, it is essential that the remote unit continue to transmit so that direction finding devices can be used to locate the child.

The remote unit of most child monitoring systems is typically quite small and the available space for a battery is therefore quite limited. Despite recent advances in battery technology, the useful life of a battery is typically related to the battery size. For example, the larger "D" cell lasting considerably longer than the much smaller and lighter "AAA" cell. Though the use of very low power electronic circuits has made possible the use of smaller batteries, a battery's useful life is still very much a factor of its physical size, which, as stated above, is limited because of the small size of a typical remote unit. Therefore, additional efforts to reduce battery drain are important.

Given that much reliance is placed on the reliability of any child monitoring system, it would be desirable for the remote unit to transmit at a low power or not at all when no danger exists. In this way battery life is increased and system reliability is improved overall, since the hazards are usually the exception rather than the rule.

Additional U.S. Pat. Nos. of interest with respect to this continuation-in-part include: 3,646,583; 3,784,842; 3,828,306; 4,216,545; 4,598,272; 4,656,463; 4675,656; 5,043,736; 5,223,844; 5,311,197; 5,334,974; 5,378,865.

SUMMARY OF THE INVENTION

It is an object of the present invention to provide a personal alarm system in which the battery operated remote unit normally transmits at low power and switches to a higher power when the distance between the remote unit and base station exceeds a predetermined limit.

It is also an object of the present invention to provide such a system which includes sensors for the hazardous conditions typically confronting young children.

It is a further object of the present invention to provide such a personal alarm system which includes a periodic handshake exchange between the remote unit and base station to demonstrate that the system continues to be operational.

In accordance with the above objects and those that will become apparent below, a personal alarm system is provided, comprising:

a remote unit including radio transmitting means and radio receiving means;

the remote unit transmitting means being able to transmit at more than one power level and defining a higher power level;

a base station including radio transmitting means and radio receiving means;

the remote unit and the base station being in radio communication and defining a separation distance between the remote unit and the base station;

measuring means for determining whether the separation distance exceeds a predetermined limit;

means responsive to the measuring means for causing the remote unit transmitting means to transmit at the higher power level when the separation distance exceeds the limit; and alarm means for indicating when the separation distance exceeds the limit.

In one embodiment of the invention, the base station transmits a periodic polling signal and the remote unit monitors the field strength of the received polling signal. If the received field strength falls below a limit, corresponding to some maximum distance between the two devices, the remote unit transmits at high power. The signal transmitted at high power includes an indication that transmission is at high power. When this signal is received by the base station, an alarm is given. The remote unit also is equipped to detect one or more hazards.

In another embodiment of the invention, there are multiple remote units each able to identify itself by including a unit identification number in its transmitted signal. The remote unit is equipped to detect one or more hazards and to identify detected hazards in its transmission. The base station is able to display the transmitting unit identification number and the type of any detected hazard.

In another embodiment, the base station, rather than the remote unit, measures the field strength of the received remote unit transmission and instructs the remote unit to transmit at high power when the received field strength falls below a preset limit.

In another embodiment, the remote unit includes both visual and audible beacons which can be activated by the base station for use in locating the child.

In another embodiment, the remote unit includes a panic button which the child or concerned person can use to summon help.

In another embodiment, the base station includes the ability to initiate a phone call via the public telephone system, for example by initiating a pager message to alert an absent caretaker.

In another embodiment, the remote unit includes a global positioning system ("GPS") receiver which is activated if a hazard is detected or if the child wanders too far from the base station. The remote unit then transmits global positioning coordinates from the GPS receiver. These coordinates are received by the base station and used in locating the child. In an alternative embodiment, the remote unit is attached to a child, pet or vehicle and the GPS receiver is activated by command from the base station. The global positioning coordinates are then used by the base station operator to locate the remote unit.

In another embodiment, the remote unit is worn by an employee doing dangerous work at a remote location such as an electrical power lineman repairing a high voltage power line. The remote unit is equipped with a GPS receiver and an electrical shock hazard sensor and the remote unit will instantly transmit the workman's location in the event of electrical shock. The device will permit an emergency medical crew to rapidly find and give aid to the injured workman and possibly save a life.

It is an advantage of the present invention to periodically test system integrity by exchanging an electronic handshake and giving an alarm in the event of failure.

It is also an advantage of the present invention to prolong the remote unit battery life by transmission at low power in the absence of a defined emergency.

It is also an advantage of the present invention that the system is able to detect and give alarm for a number of common and dangerous hazards.

It is a further advantage of the present invention to permit rapid and precise location of the remote unit which is equipped with a GPS receiver.

DETAILED DESCRIPTION OF THE INVENTION

Figure 1:
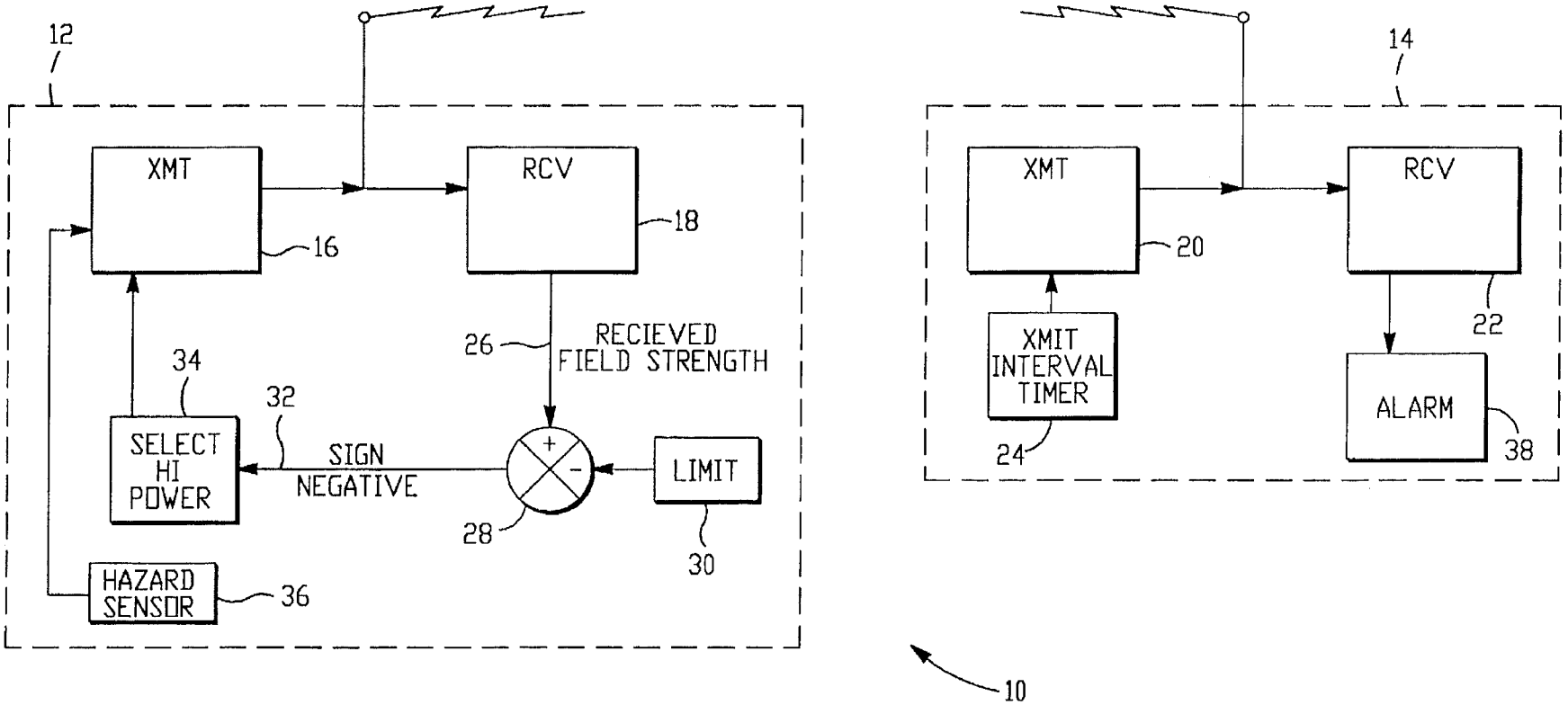
FIG. 1 is a block diagram of a personal alarm system in accordance with one embodiment of the present invention and transmitting at selectable power levels.

With reference to FIG. 1, there is shown a block diagram of a personal alarm system according to one embodiment of the present invention and depicted generally by the numeral 10. The personal alarm system 10 includes a remote unit 12 and a base station 14. The remote unit 12 has a radio transmitter 16 and a receiver 18, and the base station 14 has a radio transmitter 20 and a receiver 22. The transmitters 16, 20 and receivers 18, 22 are compatible for two-way radio communication between the remote unit 12 and the base station 14.

In a preferred embodiment, the base station 14 includes an interval timer 24 which causes the transmitter 20 to transmit at predetermined intervals. The receiver 18 of the remote unit 12 receives the signal transmitted by the base station 14 and causes the transmitter 16 to transmit a response to complete an electronic handshake.

The remote unit transmitter 16 is capable of transmitting at an energy conserving low-power level or at an emergency high-power level. When the distance between the remote unit 12 and the base station 14 exceeds a predetermined limit, the remote unit responds at the higher power level.

To accomplish the shift to the higher power level, the remote unit receiver 18 generates a signal 26 which is proportional to the field strength of the received signal, transmitted by the base station 14. The remote unit 12 includes a comparator 28 which compares the magnitude of the field strength signal 26 with a predetermined limit value 30 and generates a control signal 32.

The remote unit transmitter 16 is responsive to a circuit 34 for selecting transmission at either the low-power level or at the high-power level. The circuit 34 is connected to the control signal 32 and selects transmission at the low-power level when the received field strength equals or exceeds the limit value 30, and at the higher power level when the received field strength is less than the limit value 30. Alternatively, the remote unit transmitter 16 transmits at one of a selectable plurality of transmission power levels. In another alternative embodiment, transmission is selectable within a continuous range of transmission power levels.

Within an operating range of the personal alarm system 10, the field strength of the base station 14 transmitted signal when received at the remote unit 12 is inversely proportional to the fourth power (approximately) of the distance between the two units. This distance defines a 'separation distance,' and the predetermined limit value 30 is selected to cause transmission at the higher power level at a desired separation distance within the operating range.

In another embodiment, the remote unit 12 includes a hazard sensor 36 which is connected to the transmitter 16. The hazard sensor 36 is selected to detect one of the following common hazards, water immersion, fire, smoke, excessive carbon monoxide concentration, and electrical shock. In one embodiment, a detected hazard causes the remote unit 12 to transmit a signal reporting the existence of the hazardous condition at the moment the condition is detected. In another embodiment, the hazardous condition is reported when the response to the periodic electronic handshake occurs.

In one embodiment, the base station 14 includes an audible alarm 38 which is activated by the receiver 22. If the remote unit fails to complete the electronic handshake or reports a detected hazard or indicates it is out of range by sending an appropriate code, the base station alarm 38 is activated to alert the operator.

Figure 2:
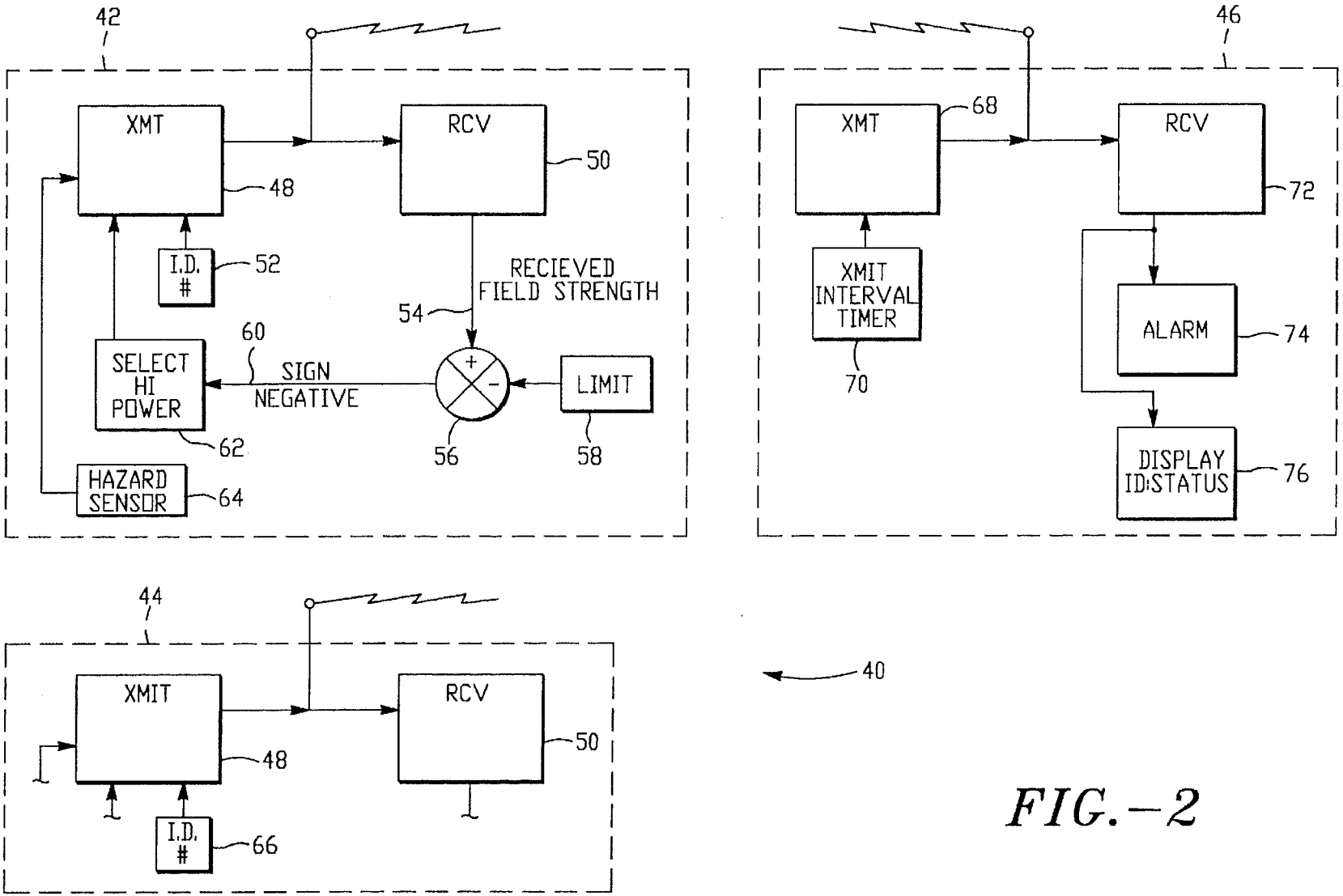
FIG. 2 is a block diagram of another embodiment of the personal alarm system illustrated in FIG. 1 including multiple remote units.

FIG. 2 is a block diagram illustrating another embodiment of the personal alarm system of the present invention. The alarm system is indicated generally by the numeral 40 and includes a first remote unit 42, a second remote unit 44 and a base station 46. The first remote unit 42 includes a transmitter 48, a receiver 50, an identification number 52, a received field strength signal 54, a comparator 56, a predetermined limit value 58, a control signal 60, a power level select circuit 62 and a hazard sensor 64.

The second remote unit 44 includes a separate identification number 66, but is otherwise identical to the first remote unit 42.

The base station 46 includes a transmitter 68, an interval timer 70, a receiver 72, an alarm 74 and an ID-Status display 76.

In one embodiment of the invention illustrated in FIG. 2, the radio transmission between the first remote unit 42 and the base station 46 includes the identification number 52. The transmission between the second remote unit 44 and the base station 46 includes the identification number 66. It will be understood by those skilled in the art that the system may include one or more remote units, each having a different identification number 52.

It will also be understood that each remote unit 42 may have a different predetermined limit value 58. The limit value 58 defines a distance between the remote unit 42 and the base station 46 beyond which the remote unit will transmit at its higher power level. If a number of remote units are being used to monitor a group of children, in a school playground for example, the limit values of each remote unit may be set to a value which will cause high power transmission if the child wanders outside the playground area. In other applications, the limit value 58 of each remote unit 42 may be set to a different value corresponding to different distances at which the individual remote units will switch to high power transmission.

In one embodiment, the base station 46 will provide an alarm 74 whenever a remote unit transmits at high power or reports the detection of a hazard. The identification number of the reporting remote unit and an indication of the type of hazard is displayed by the base station on the ID-Status display 76. This information can be used by the operator, for example a day-care provider, to decide what response is appropriate and whether immediate caretaker notification is required. If a child has merely wandered out of range, the provider may simply send an associate out to get the child and return her to the play area. On the other hand, a water immersion hazard indication should prompt immediate notification of caretakers and emergency personnel and immediate action by the day-care employees.

In another embodiment, the remote unit receiver 50 determines that the separation distance between the remote unit 42 and the base station 46 exceeds the predetermined threshold. The remote unit transmitter 48 transmits a code or status bit to indicate that fact.

In an embodiment illustrated in FIG. 1, the polling message transmitted periodically by the base station 14 is an RF carrier. The carrier frequency is transmitted until a response from the remote unit 12 is received or until a watchdog timer (not illustrated) times out, resulting in an alarm. The information contained in the remote unit response must include whether transmission is at low power or at high power, and whether a hazard has been detected, since the base station provides an alarm in either of these instances.

In an embodiment illustrated in FIG. 2, however, additional information must be reported and the advantages of a digitally formatted remote unit response will be apparent to those possessing an ordinary level of skill in the art.

Figure 3:
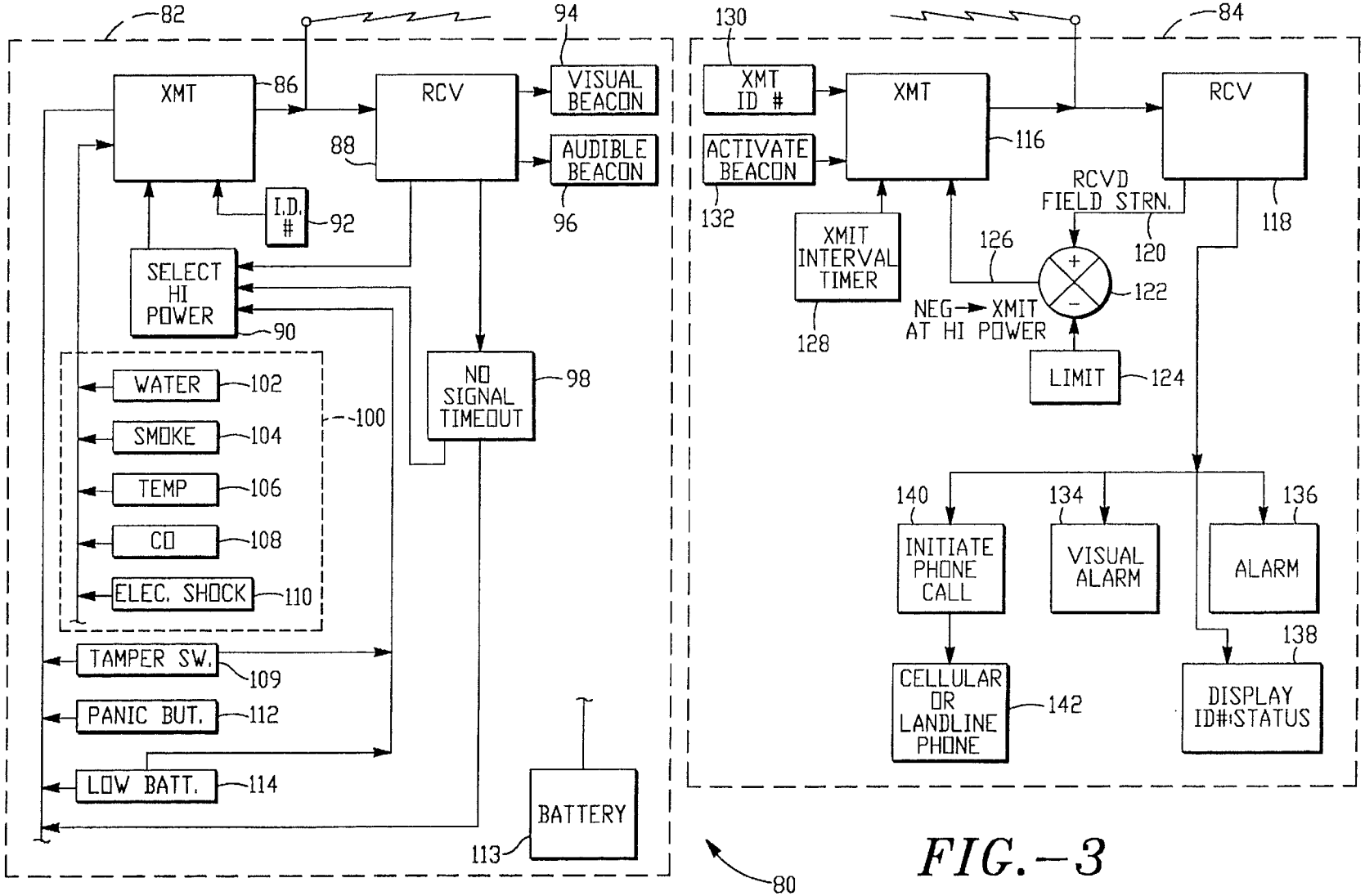
FIG. 3 is a block diagram illustrating another embodiment of the personal alarm system in accordance with the present invention.

FIG. 3 is a block diagram illustrating another embodiment of the personal alarm system in accordance with the present invention and generally indicated by the numeral 80. Personal alarm system 80 includes a remote unit 82 and a base station 84.

The remote unit 82 includes a transmitter 86, a receiver 88, a power level select circuit 90, an ID number 92, a visual beacon 94, an audible beacon 96, a watchdog timer 98, a plurality of hazard sensors 100 including a water immersion sensor 102, a smoke sensor 104, a heat sensor 106, a carbon monoxide sensor 108, a tamper switch 109, and an electrical shock sensor 110, an emergency switch ("panic button") 112, a battery 113, and a 'low battery power' sensor 114.

The base station 84 includes a transmitter 116, a receiver 118 which produces a received field strength signal 120, a comparator 122, a predetermined limit value 124, a comparator output signal 126, an interval timer 128, control signals 130 and 132, a visual alarm 134, an audible alarm 136, an ID and Status display 138, a circuit 140 for initiating a phone call and a connection 142 to the public telephone system.

The base station 84 and a plurality of the remote units 82 illustrated in the embodiment of FIG. 3 communicate using a digitally formatted message. One message format is used by the base station 84 to command a specific remote unit 82, and a second message format is used by a commanded remote unit 82 to respond to the base station 84. These message formats are illustrated in FIGS. 5 and 4, respectively.

Figure 4:
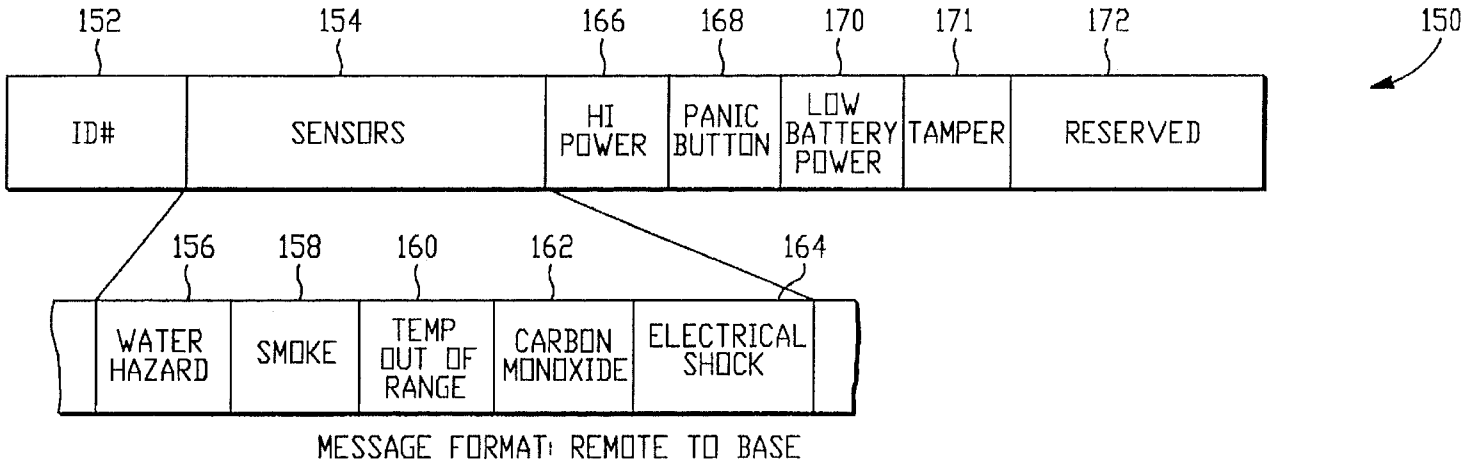
FIG. 4 is a pictorial diagram illustrating a preferred message format used by the personal alarm system illustrated in FIG. 2.

With reference to FIG. 4 there is shown a pictorial diagram of a preferred digital format for a response from a remote unit in a personal alarm system in accordance with the present invention, indicated generally by the numeral 150. The digital response format 150 includes a remote unit ID number 152, a plurality of hazard sensor status bits 154 including a water immersion status bit 156, a smoke sensor status bit 158, a heat sensor status bit 160, an excessive carbon monoxide concentration status bit 162, and an electrical shock status bit 164. The response 150 also includes a high power status bit, 166, a panic button status bit 168, a low battery power detector status bit 170, a tamper switch status bit 171, and bits reserved for future applications 172.

Figure 5:
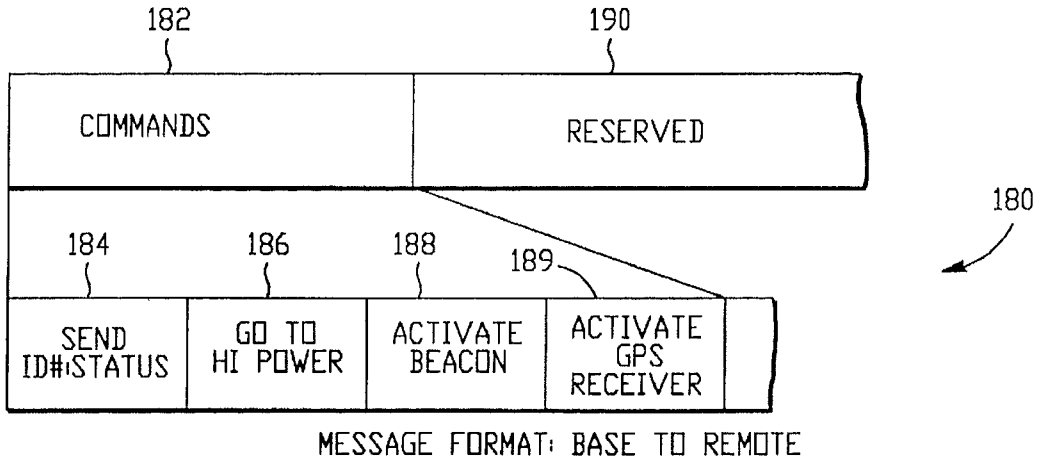
FIG. 5 is a pictorial diagram illustrating another preferred message format used by the personal alarm system illustrated in FIG. 2.
Figure 6:
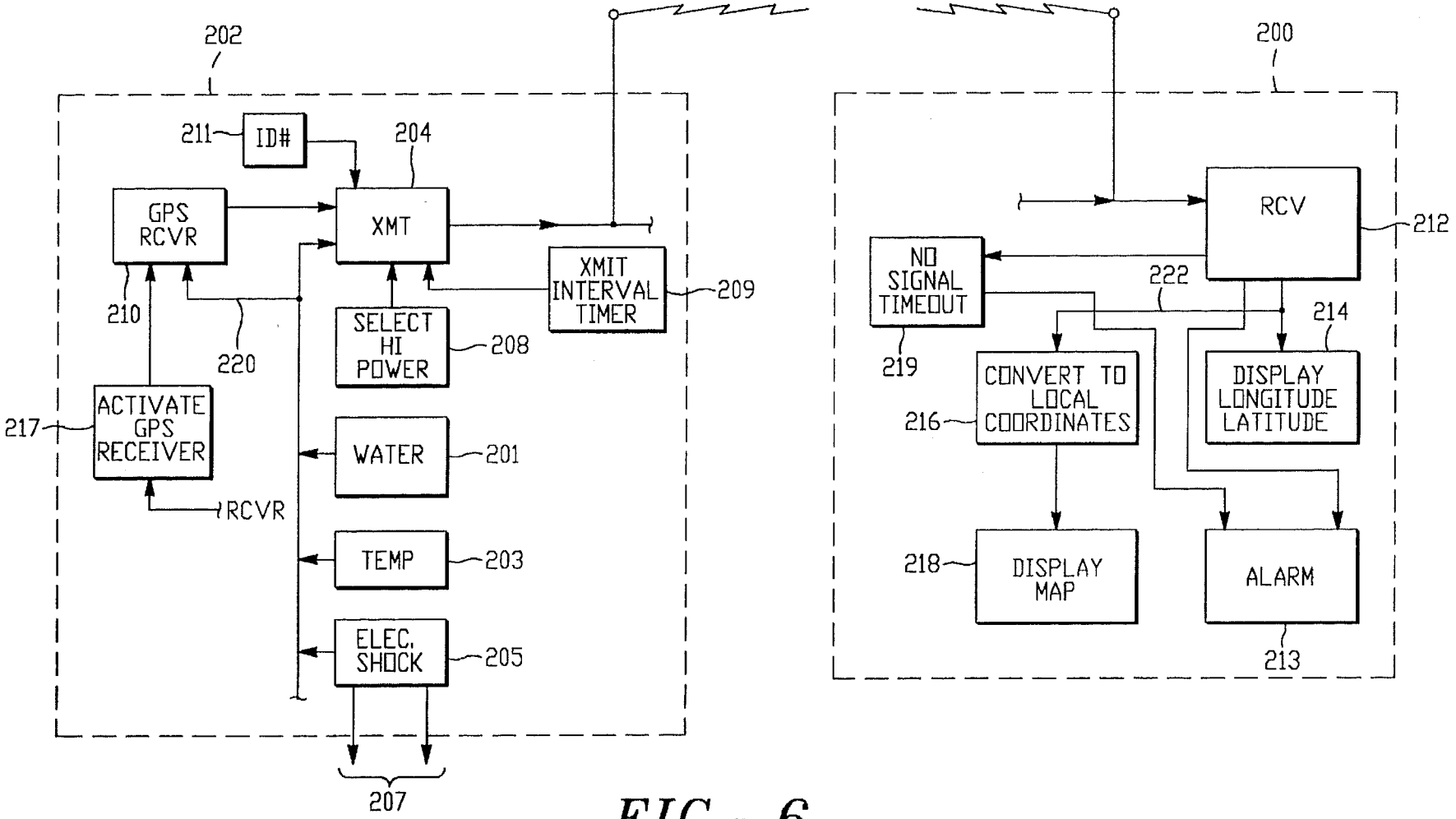
FIG. 6 is a block diagram illustrating an embodiment of the personal alarm system of the present invention using the Global Positioning System to improve remote unit location finding.

FIG. 5 is a pictorial diagram of a preferred digital format for a base station to remote unit transmission, generally indicated by the numeral 180. The digital message format 180 includes a command field 182 and a plurality of unassigned bits 190 reserved for a future application. The command field 182 includes a coded field of bits 184 used to command a specific remote unit to transmit its response message (using the format 150). The command field 182 also includes a single bit 186 used to command a remote unit, such as the embodiment illustrated in FIG. 3, to transmit at high power. The command field 182 includes command bit 188 used to command a remote unit to activate a beacon, such as the visual beacon 94 and the audible beacon 96 illustrated in FIG. 3. The command field 182 also includes command bit 189, used to command a remote unit to activate a GPS receiver, see for example 'Activate GPS Receiver' 217 as shown in FIG. 6.

In an alternative embodiment, the remote unit transmitter is adapted to transmit at one of a plurality of transmission power levels and the single command bit 186 is replaced with a multi-bit command sub-field for selection of a power level. In another embodiment, the remote unit transmitter is adapted to transmit at a power level selected from a continuum of power levels and a multi-bit command sub-field is provided for the power level selection.

Again with respect to FIG. 3, the Base station 84 periodically polls each remote unit 82 by transmitting a command 180 requiring the remote unit 82 to respond with message format 150. The polling is initiated by the interval timer 128 which causes the base station transmitter 116 to transmit the outgoing message 180. The numerals 150 and 180 are used to designate both the format of a message and the transmitted message. A specific reference to the format or the transmitted message will be used when necessary for clarity. As is common in the communications industry, the message will sometimes be referred to as a 'signal,' at other times as a 'transmission,' and as a 'message;' a distinction between these will be made when necessary for clarity.

The message 180 is received by all remote units and the remote unit to which the message is directed (by the coded field 184) responds by transmitting its identification number 152 and current status, bits 154–170. The remote unit identification number 92 is connected to the transmitter 86 for this purpose.

In the embodiment illustrated in FIG. 3, the function of measuring received field strength to determine whether a predetermined separation distance is exceeded is performed in the base station 84. The base station receiver 118 provides a received field strength signal 120 which is connected to the comparator 122. The predetermined limit value 124 is also connected to the comparator 122 which provides a comparitor output signal 126. If the received field strength 120 is less than the limit value 124, the comparator output signal 126 is connected to assert the "go-to-high-power" command bit 186 in the base unit 84 outgoing message 180. The limit value 124 is selected to establish the predetermined separation distance beyond which transmission at high power is commanded.

In one embodiment, the selection of the limit value 124 is accomplished by the manufacturer by entering the value into a read-only memory device. In another embodiment, the manufacturer uses manually operated switches to select the predetermined limit value 124. In another embodiment, the manufacturer installs jumper wires to select the predetermined limit value 124. In yet another embodiment, the user selects a predetermined limit value 124 using manually operated switches.

The remote unit transmitter 86 is capable of transmitting at a power-conserving lower power level and also at an emergency higher power level. Upon receiving a message 180 including the remote unit identification number 184, the remote unit receiver passes the "go-to-high-power" command bit 186 to the power level select circuit 90 which is connected to command the remote unit transmitter 86 to transmit a response 150 at the higher power level. The response 150 includes status bit 166 used by the remote unit 82 to indicate that it is transmitting at high power.

In one embodiment, the remote unit includes the watchdog timer 98 (designated a 'No Signal Timeout') which is reset by the receiver 88 each time the remote unit 82 is polled. If no polling message 180 is received within the timeout period of the watchdog timer 98, the remote unit transmitter 86 is commanded to transmit a non-polled message 150. In another embodiment, the remote unit transmitter 86 switches to the higher power if no polling message 180 is received within the timeout period of the watchdog timer 98.

In one embodiment of the invention, the remote unit 82 includes a manually operated switch ("panic button") 112 which is connected to the transmitter 86 to command the transmission of a non-polled message 150. The panic button status bit 168 is set in the outgoing message 150 to indicate to the base station 84 that the panic button has been depressed. Such a button can be used by a child or invalid or other concerned person to bring help.

In another embodiment, the remote unit includes a tamper switch 109 which is activated if the remote unit is removed from the child, or is otherwise tampered with. The activation of the tamper switch 109 causes the remote unit to transmit a code or status bit to the base unit to identify the cause of the change of status ('Tamper' status bit 171 illustrated in FIG. 4). In one related alternative, the remote unit transmits at the higher power level when the switch is activated by removal of the remote unit from the child's person.

In another embodiment, the remote unit 82 includes a circuit 114 which monitors battery power. The circuit 114 is connected to initiate a non-polled message 150 if the circuit determines that battery power has fallen below a predetermined power threshold. The message 150 will include the "low-battery-power" status bit 170. In an alternative embodiment, a low battery power level will initiate a remote unit transmission at the higher power level (see FIG. 3).

In the embodiment illustrated in FIG. 3, the remote unit 82 includes several hazard sensors 100. These sensors are connected to report the detection of common hazards and correspond to the sensor status bits 154 in the remote unit response message 150.

In another embodiment of the present invention, the base station receiver 118 is connected to a visual alarm 134 and an audible alarm 136 and will give an alarm when a message 150 is received which includes any hazard sensor report 154 or any of the status bits 166–170.

The base station 84 also includes the status and ID display 138 used to display the status of all remote units in the personal alarm system 80.

In another embodiment of the personal alarm system 80, the base station 84 includes a circuit 140 for initiating a telephone call when an emergency occurs. The circuit 140 includes the telephone numbers of persons to be notified in the event of an emergency. A connection 142 is provided to a public landline or cellular telephone system. The circuit 140 can place calls to personal paging devices, or alternatively place prerecorded telephone messages to emergency personnel, such as the standard "911" number.

FIG. 6 is a partial block diagram illustrating an embodiment of the invention having a base station 200 and at least one remote unit 202. The partially illustrated remote unit 202 includes a transmitter 204, hazard sensors 201, 203, 205, a circuit 208 for causing the transmitter to transmit at a higher power level, a transmit interval timer 209, and a Global Positioning System ('GPS') receiver 210. The partially illustrated base station 200 includes a receiver 212, an alarm 213, a display 214 for displaying global positioning coordinates of longitude and latitude, a circuit 216 for converting the global positioning coordinates into predefined local coordinates, a map display 218 for displaying a map in the local coordinates and indicating the location of the remote unit 202, and a watchdog timer 219.

In a preferred embodiment of the alarm system, the remote unit transmitter 204 is connected to receive the global positioning coordinates from the GPS receiver 210 for transmission to the base station 200.

The GPS receiver 210 determines its position and provides that position in global positioning coordinates to the transmitter 204. The global position coordinates of the remote unit 202 are transmitted to the base station 200. The base station receiver 212 provides the received global positioning coordinates on line 222 to display 214 and to coordinate converter 216. The display 214 displays the global coordinates in a world-wide coordinate system such as longitude and latitude.

In one embodiment of the alarm system, the coordinate converter 216 receives the global positioning coordinates from line 222 and converts these into a preferred local coordinate system. A display 218 receives the converted coordinates and displays the location of the remote unit 202 as a map for easy location of the transmitting remote unit 202.

In another embodiment of the alarm system, the GPS receiver 210 includes a low power standby mode and a normal operating mode. The GPS receiver 210 remains in the standby mode until a hazard is detected and then switches to the normal operating mode.

In another embodiment of the alarm system, the GPS receiver 210 remains in the standby mode until commanded by the base station 200 to enter the normal operating mode (see command bit 189 illustrated in FIG. 5).

In another embodiment of the alarm system, the remote trait transmitter 204 is connected to the hazard sensors 201–205 for transmission of detected hazards. The base station receiver 212 is connected to activate the alarm 213 upon detection of a hazard.

In one embodiment, a conventional electrical shock sensor 205 includes a pair of electrical contacts 207 which are attached to the skin of a user for detection of electrical shock.

In another embodiment, the remote unit 202 includes a transmit interval timer 209 and an ID number 211. The timer 209 is connected to cause the remote unit to transmit the ID number at predetermined intervals. The base station 200 includes a watchdog timer 219 adapted to activate the alarm 213 if the remote unit fails to transmit within the prescribed interval.

In another embodiment of the alarm system, the remote unit 202 includes a carbon monoxide concentration sensor (see 108 of FIG. 3) having an output signal connected to activate a sensor status bit (see 162 of FIG. 4) for transmission to the base station 200.

Figure 7:
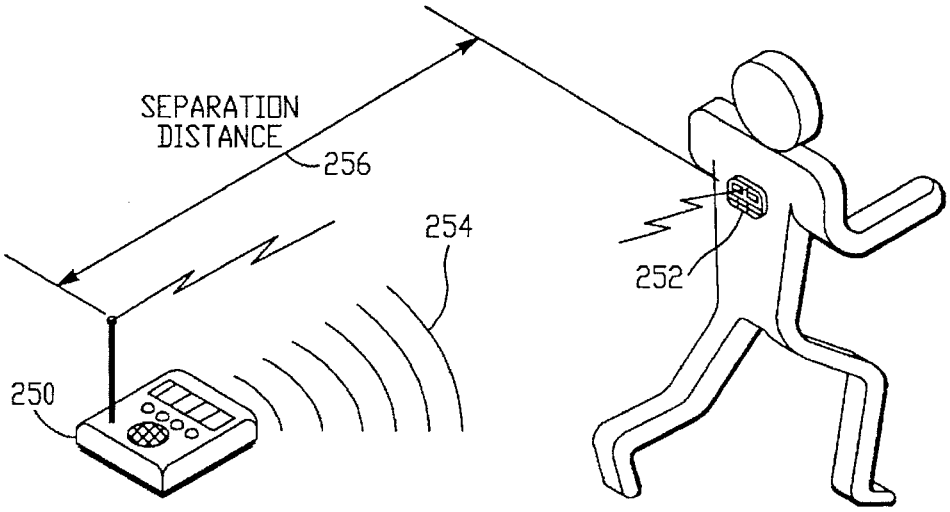
FIG. 7 is a pictorial diagram illustrating a base station and remote unit of the personal alarm system of FIG. 1, in a typical child monitoring application.
Figure 8:
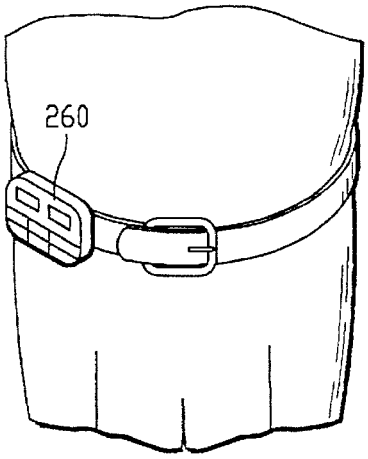
FIG. 8 is a pictorial diagram illustrating a remote unit in accordance with the present invention being worn at the waist.
Figure 9:
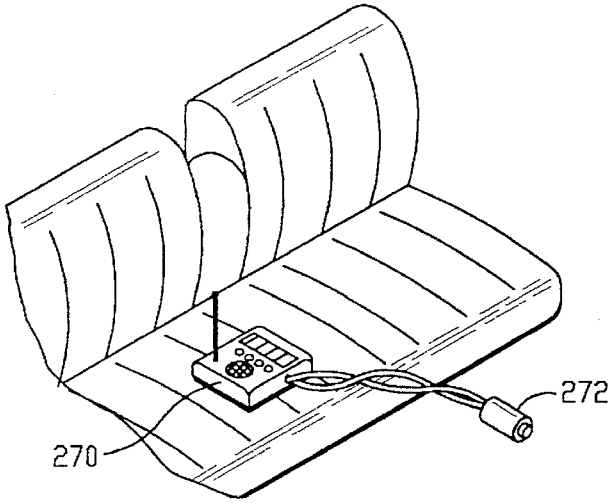
FIG. 9 is a pictorial diagram illustrating a mobile base station in accordance with the present invention for operation from a vehicle electrical system.
Figure 10:
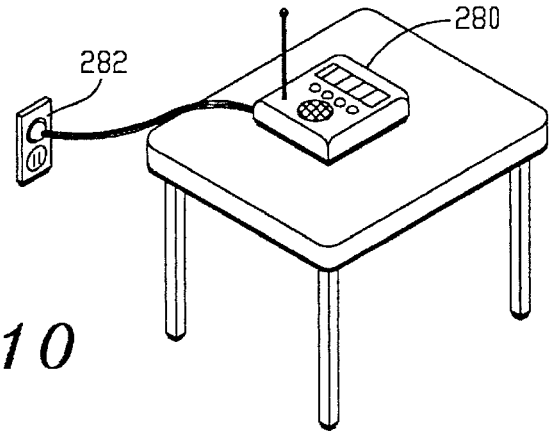
FIG. 10 is a pictorial diagram illustrating a base station in accordance with the present invention being operated from ordinary household power.

FIGS. 7–10 are pictorial illustrations of alternative embodiments of the personal alarm system of the present invention. FIG. 7 illustrates a base station 250 in two-way radio communication with a remote unit 252 worn by a child. The child is running away from the base station 250 such that the separation distance 256 has exceeded the preset threshold. The base station has determined that an alarm should be given, and an audible alarm 254 is being sounded to alert a responsible caretaker. FIG. 8 illustrates a remote unit 260 worn at the waist of a workman whose location and safety are being monitored. FIG. 9 illustrates a mobile base station 270 equipped with a cigarette lighter adapter 272 for operation in a vehicle. FIG. 10 illustrates a base station 280 adapted for operation from ordinary household current 282.

Figure 11:
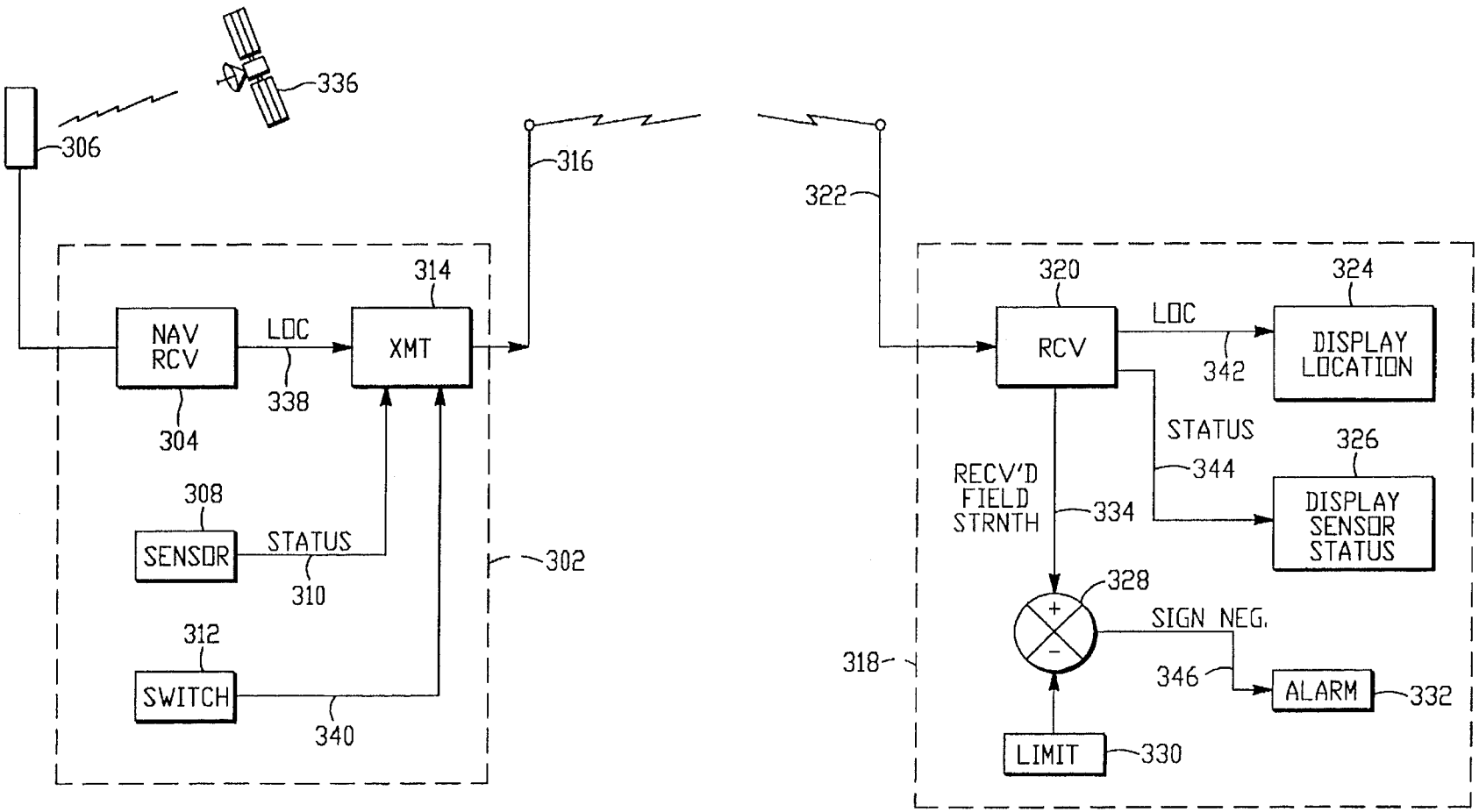
FIG. 11 is a block diagram illustrating a man-over-board alarm system in accordance with one aspect of the present invention.

FIG. 11 is a block diagram which illustrates a man-over-board system in accordance with one aspect of the present invention, and designated generally by the numeral 300.

The man-over-board system 300 includes a remote unit 302, having a navigational receiver 304 and antenna 306 for receiving navigational information, a sensor 308, having an output signal 310, a manually operated switch 312, and a radio transmitter 314 having an antenna 316. The man-over-board system 300 also includes a base station 318 having a radio receiver 320 connected to an antenna 322 for receiving radio transmissions from the remote unit 302. The base station 318 also includes a display 324 for displaying the navigational location of the remote unit 302, a display 326 for displaying the status of the sensor 308, a circuit 328 for comparing the field strength of the received radio transmission with a predetermined limit 330, and an alarm 332 which is activated when the received field strength 334 falls below the value of the limit 330.

In use, the remote unit 302 is worn by a user and an alarm will be given if the user falls over board and drifts too far from the boat. The navigational receiver 304 receives navigational information, as for example from global positioning satellites 336. The navigational receiver 304 converts the navigational information into a location of the remote unit 302 and outputs the location 338 to the radio transmitter 314 for transmission to the base station 318.

The sensor 308 provides an output signal 310 and defines a sensor status. The output signal 310 is connected to the radio transmitter 314 for transmitting the sensor status to the base station 318.

The manually operated switch 312 includes an output 340 which is connected to the radio transmitter 314 and permits the user to signal the base station 318 by operating the switch 312. In a preferred embodiment, the manually operated switch 312 defines a panic button.

The radio receiver 320 provides three outputs, the received location 342 of the remote unit 302, the received sensor status 344, and an output signal 334 proportional to the field strength of the received radio transmission. As described above with respect to FIGS. 1–3, the remote unit 302 and the base station 318 define a separation distance which is inversely proportional to the received field strength. The comparator circuit 328 compares the received field strength 334 with a predetermined limit 330 and produces an output signal 346 if the sign of the comparison is negative, indicating that the field strength of the received signal is less than the limit 330. If the user drifts beyond a separation distance from the boat defined by the limit 330, the alarm 332 is activated to alert the user's companions, who can then take appropriate action.

In heavy seas or poor visibility, the base station 318 displays the current location of the remote unit 302 on a suitable display 324. This is done in some appropriate coordinate system, such as standard longitude and latitude. This feature permits the base station to maintain contact with the man-over-board despite failure to maintain direct eye contact.

Figure 12:
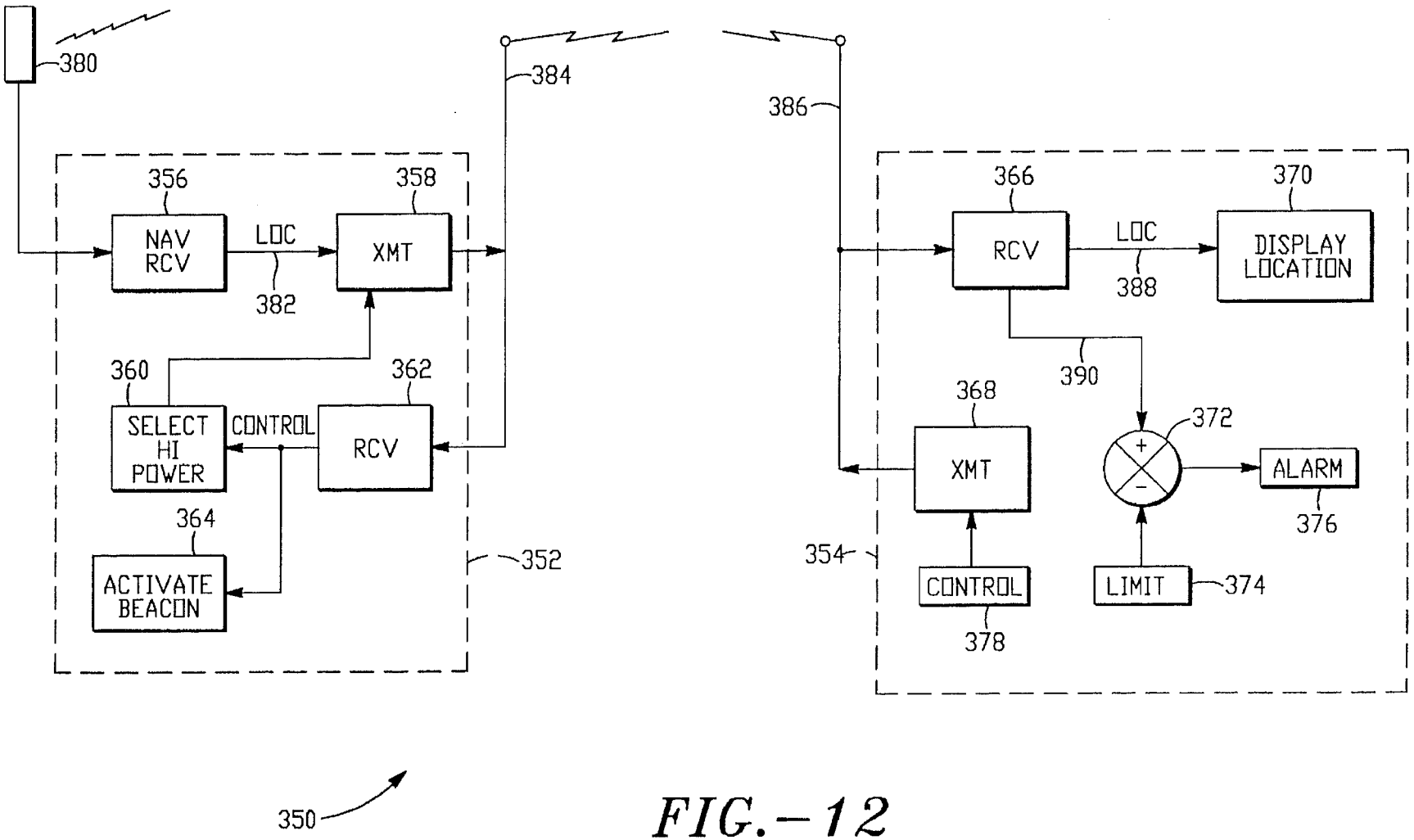
FIG. 12 is a block diagram illustrating another embodiment of the man-over-board alarm system.

FIG. 12 is a block diagram which illustrates a man-over-board system including a two-way radio communication link and designated generally by the numeral 350. The man-over-board system 350 includes a remote unit 352 and a base station 354.

The remote unit 352 includes a navigational receiver 356, a radio transmitter 358, a circuit 360 for causing the radio transmitter 358 to transmit at a high power level, a radio receiver 362, and circuits 364 for activating a beacon.

The base station 354 includes a radio receiver 366, a radio transmitter 368, a display 370 for displaying the location of the remote unit 352, a compactor circuit 372, a predetermined limit 374, an alarm 376, and control circuits 378 for activating the radio transmitter 368.

The navigational receiver 356 is connected to an antenna 380 for receiving navigational information, such as from global positioning system satellites (not shown). The receiver provides the location 382 of the remote unit 352 for radio transmission to the base station 354.

The remote unit radio transmitter 358 and radio receiver 362 are connected to an antenna 384 for communication with the base station 354. The base station radio receiver 366 and radio transmitter 368 are connected to an antenna 386 for communication with the remote unit 352.

The base station radio receiver 366 provides two outputs, the location 388 of the remote unit for display by the location display 370, and a signal 390 whose value is inversely proportional to the field strength of the signal received by the radio receiver 366.

The received field strength signal 390 and the predetermined limit 374 are compared by the comparator circuit 372 to determine whether the remote unit 352 is separated from the base station 354 by a distance greater than the predetermined limit 374. An alarm 376 is given when the separation distance exceeds the limit.

The control circuits 378 are used to cause the radio transmitter 368 to send a control signal to the remote unit 352 for selecting high-power remote unit radio transmission, or activating a visual or audible beacon for use in locating the user in heavy seas or bad visibility.

Figure 13:
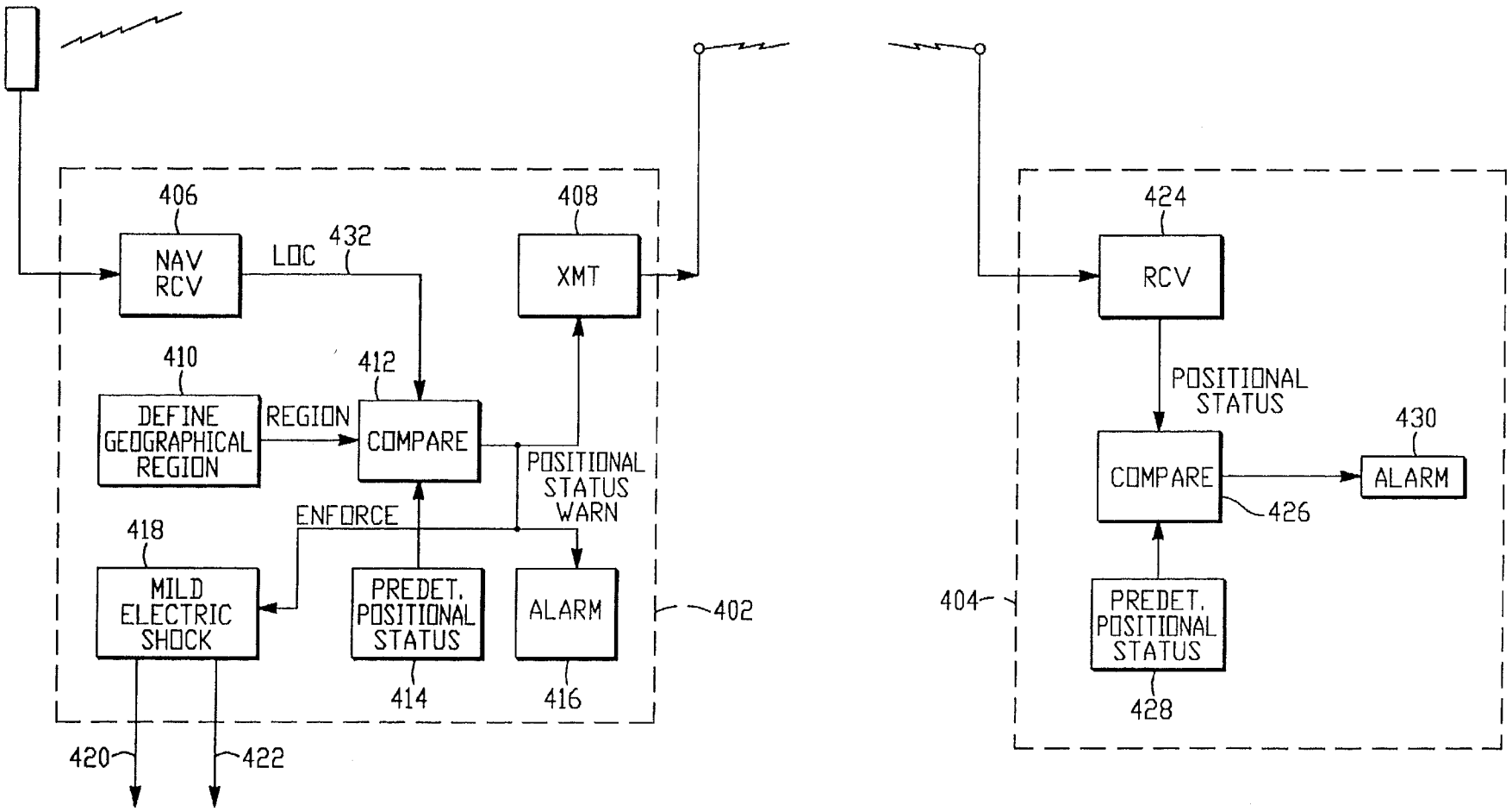
FIG. 13 is a block diagram illustrating an invisible fence monitoring system according to another aspect of the present invention.

FIG. 13 is a block diagram which illustrates an invisible fence for monitoring a movable subject and designated generally by the numeral 400. The invisible fence 400 includes a remote unit 402 and a base station 404 in one-way radio communication.

The remote unit 402 includes a navigational receiver 406, a radio transmitter 408, storage circuits 410 for storing information defining a geographical region, a comparator 412, second storage circuits 414 for storing information defining a predetermined positional status, an alarm 416, and a circuit 418 and having a pair of electrical contacts 420, 422 for providing a mild electrical shock.

The base station 404 includes a radio receiver 424, a comparator 426, storage circuits 428 for storing information defining a predetermined positional status, and an alarm 430.

In the embodiment illustrated in FIG. 13, the invisible fence 400 defines a geographical region, for example the outer perimeter of a nursing home in which elderly persons are cared for. If a particular patient tends to wander away from the facility, creating an unusual burden upon the staff, the remote unit 402 is attached to the patient's clothing. If the patient wanders outside the defined perimeter, the base station 404 alerts the staff before the patient has time to wander too far from the nursing home.

Other applications are keeping a pet inside the yard, and applying a mild electrical shock to the pet if it wanders too close to a defined perimeter. Attaching the remote unit 402 to a child and alerting the caregiver in the event the child strays from a permitted area. Placing the remote unit around the ankle of a person on parole or probation and giving an alarm if the parolee strays from a permitted area. The invisible fence can also be used to monitor movement of inanimate objects whose locations may change as the result of theft.

The remote unit navigational receiver 406 provides the location 432 of the remote unit. In a preferred embodiment, the storage circuits 410 are implemented using ROM or RAM, as for example within an embedded microprocessor. Consideration of FIGS. 14–16 is useful to an understanding of how the invisible fence operates.

Figure 14:
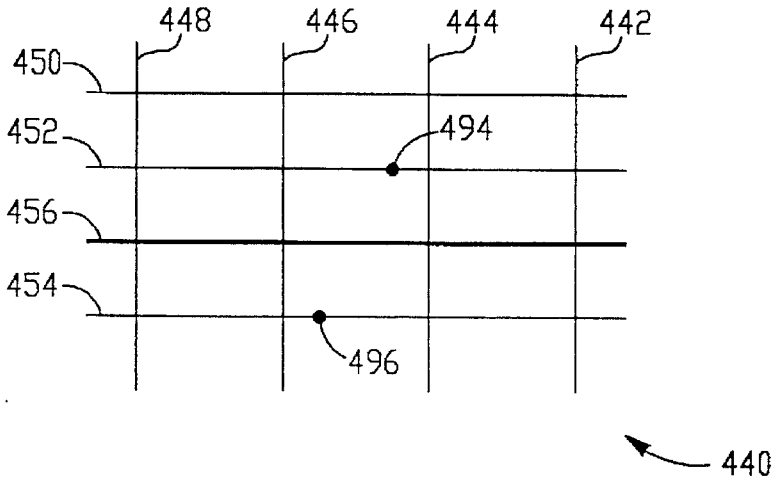
FIG. 14 is a pictorial diagram illustrating a boundary defining a geographical region for use with the invisible fence system of FIG. 13.
Figure 15:
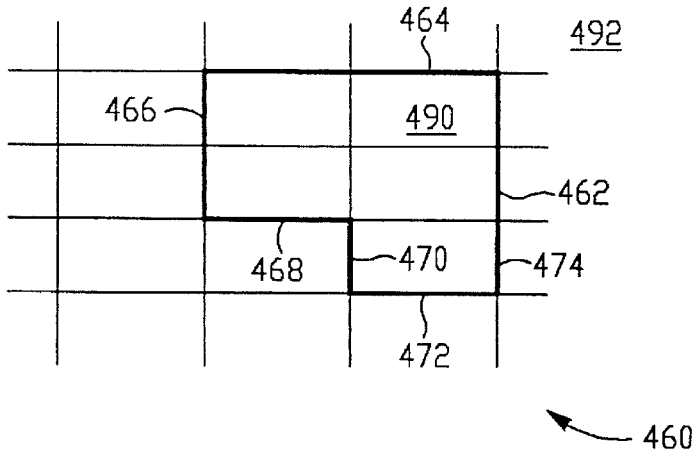
FIG. 15 is another pictorial diagram illustrating a defined region having a closed boundary.
Figure 16:
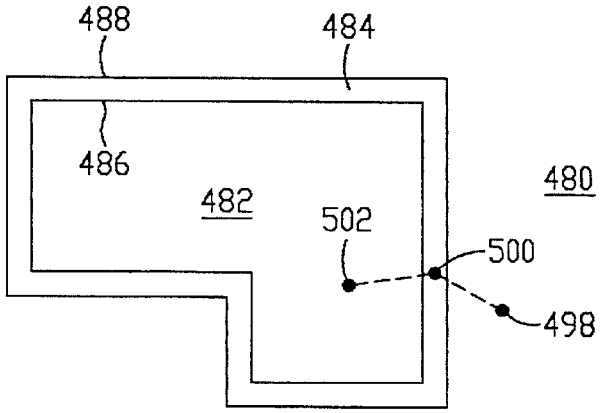
FIG. 16 is another pictorial diagram illustrating a defined region including defined subdivisions.

FIGS. 14, 15 and 16 are pictorial diagrams illustrating boundaries used to define geographical regions such as those used in a preferred embodiment of the invisible fence 400.

FIG. 14 shows a portion 440 of a city, including cross streets 442–454 and a defining boundary 456. The boundary 456 divides the map 440 into two portions, one portion above boundary 456, the other portion below.

FIG. 15 shows a portion 460 of a city, including cross streets (not numbered) and a closed boundary 462 made up of intersecting line segments 464, 466, 468, 470, 472 and 474. The boundary 462 divides the city map 460 into two subregions, one subregion defining an area 490 wholly within the boundary 462, and the other subregion defining an area 492 outside the boundary 462.

FIG. 16 shows a geographical region 480 which includes subregions 482 and 484. Subregion 482 is entirely surrounded by subregion 484, while subregion 484 is enclosed within a pair of concentric closed boundaries 486 and 488.

The information which defines these geographical regions and boundaries is stored in the storage circuits 410, and serve as one input to the comparator 412 (FIG. 13). The comparator 412 also receives the location output 432 from the navigational receiver 406. The comparator 412 compares the location of the remote unit 402 with the defined geographical region and defines a relationship between the location and the defined region which is expressed as a positional status. The comparator 412 also receives an input from the second storage circuits 414. These circuits store information defining a predetermined positional status.

Some examples will be useful in explaining how the positional status is used. Referring to FIG. 14, remote unit locations 494 and 496 are illustrated as dots, one location 494 being above the boundary 456, the other location 496 being below the boundary.

For the first example, assume that the location 494 is "within a defined geographical region," and that the location 496 is "outside the defined geographical region." Assume also that the predetermined positional status is that "locations within the defined region are acceptable." Next assume that the navigational receiver 406 reports the location 494 for the remote unit. Then the comparator 412 will define a positional status that "the location of the remote unit relative to the defined region is acceptable." This positional status will be transmitted to the base station 404 and will not result in activation of the alarm 430.

For the next example, assume that that the navigational receiver 406 reports the location of the remote unit to be the location 496, and that the other assumptions remain the same. Then the comparator 412 will define a positional status that "the location of the remote unit relative to the defined region is not acceptable." This positional status will be transmitted to the base station 404 and will result in activation of the alarm 430.

For the next example refer to FIG. 16 which includes three successive locations 498, 500 and 502, shown linked by a broken line, as for example by movement of the remote unit 402 from location 498 to location 500 to location 502. Assume that the area outside the boundary 488 defines an "acceptable" subregion. Assume further that the area between the boundaries 488 and 486 defines a "warning" subregion. Also assume that the area 482 inside the boundary 486 defines a "prohibited" subregion. Finally, assume that the navigational receiver 406 provides three successive locations 498, 500 and 502.

In a preferred embodiment, and given these assumptions in the preceding paragraph, the comparator 412 will determine that the location 498 is acceptable and will take no further action. The comparator 412 will determine that the location 500 is within the warning subregion 484 and will activate the remote unit alarm 416 to warn the person whose movements are being monitored that he has entered a warning zone. When the remote unit 402 arrives at the location 502, the comparator 412 will determine that the remote unit has entered a prohibited zone and will activate the mild electric shock circuit 418 which makes contact with the skin of the monitored person through the electrical contacts 420, 422. The positional status reported by the remote trait 402 for the successive locations 498, 500 and 502 is "acceptable," "warning given," and "enforcement necessary," respectively.

In another embodiment, no enforcement or warning are given by the remote unit 402. Instead, as when used to monitor the movements of children or elderly patients, the positional status is transmitted to the base station 404. There it is compared with a stored predetermined positional status and used to set an alarm 430 if the positional status is not acceptable. The predetermined positional status is stored in storage circuits 428 and the comparison is made by the comparator 426.

The preferred embodiment for the storage and comparison circuits is the use of an embedded microprocessor.

Figure 17:
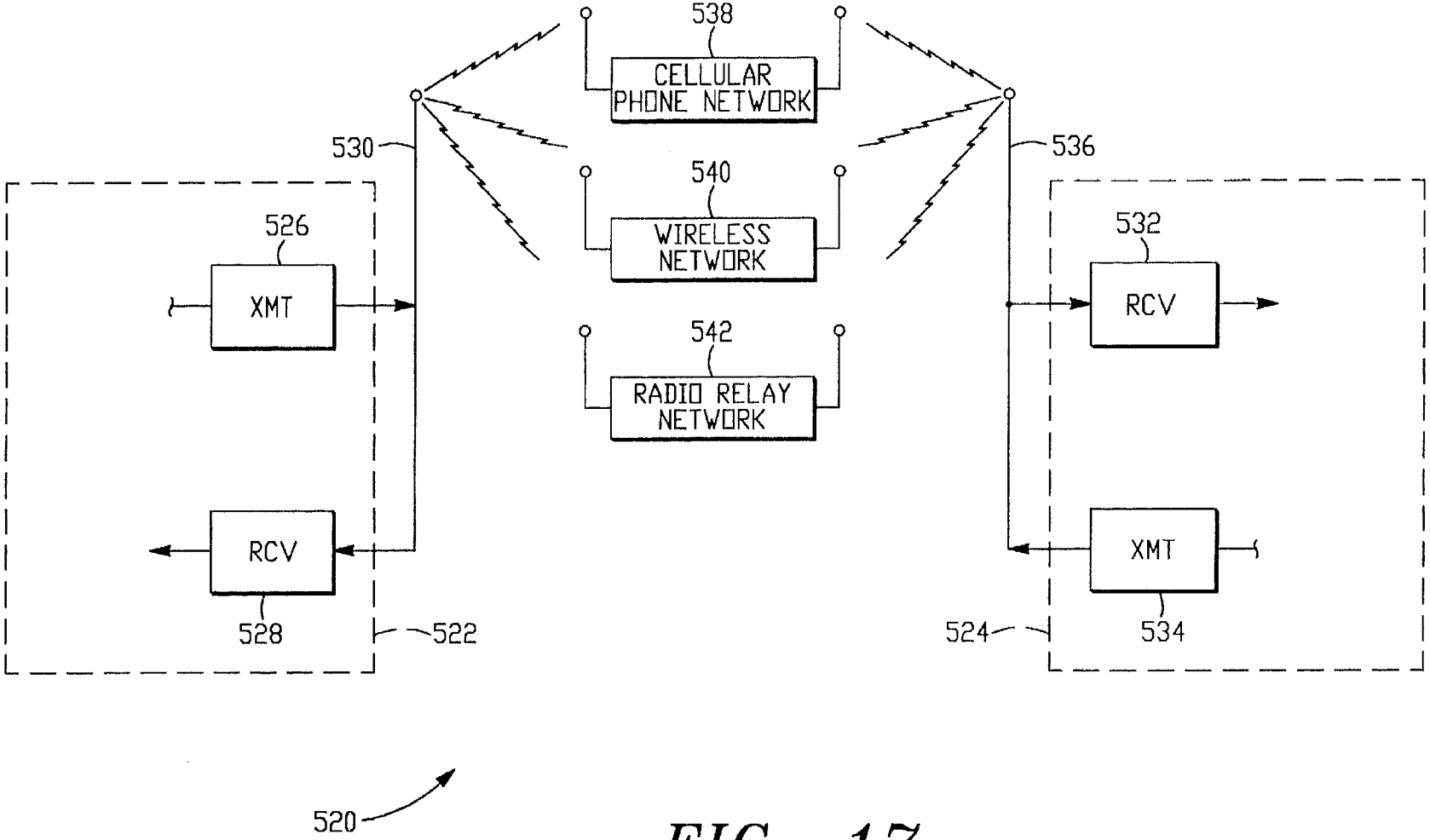
FIG. 17 is a block diagram illustrating another aspect of the invisible fence system.

FIG. 17 is a block diagram illustrating a personal alarm system such as the invisible fence of FIG. 13, and designated generally by the numeral 520. Personal alarm system 520 includes a remote unit 522 and a base station 524.

The remote unit 522 includes a radio transmitter 526 and a radio receiver 528 connected to a shared antenna 530. The base station 524 includes a radio receiver 532 and a radio transmitter 534 connected to a shared antenna 536 and defining a two-way communication link with the remote unit 522.

In one preferred embodiment, the communication link is direct between the respective transmitters 526, 534 and the corresponding receivers 528, 532. Other embodiments include access to existing commercial and private communications networks for completing the communication link between the remote unit 522 and the base station 524. Typical networks include a cellular telephone network 538, a wireless communications network 540, and a radio relay network 542.

Figure 18:
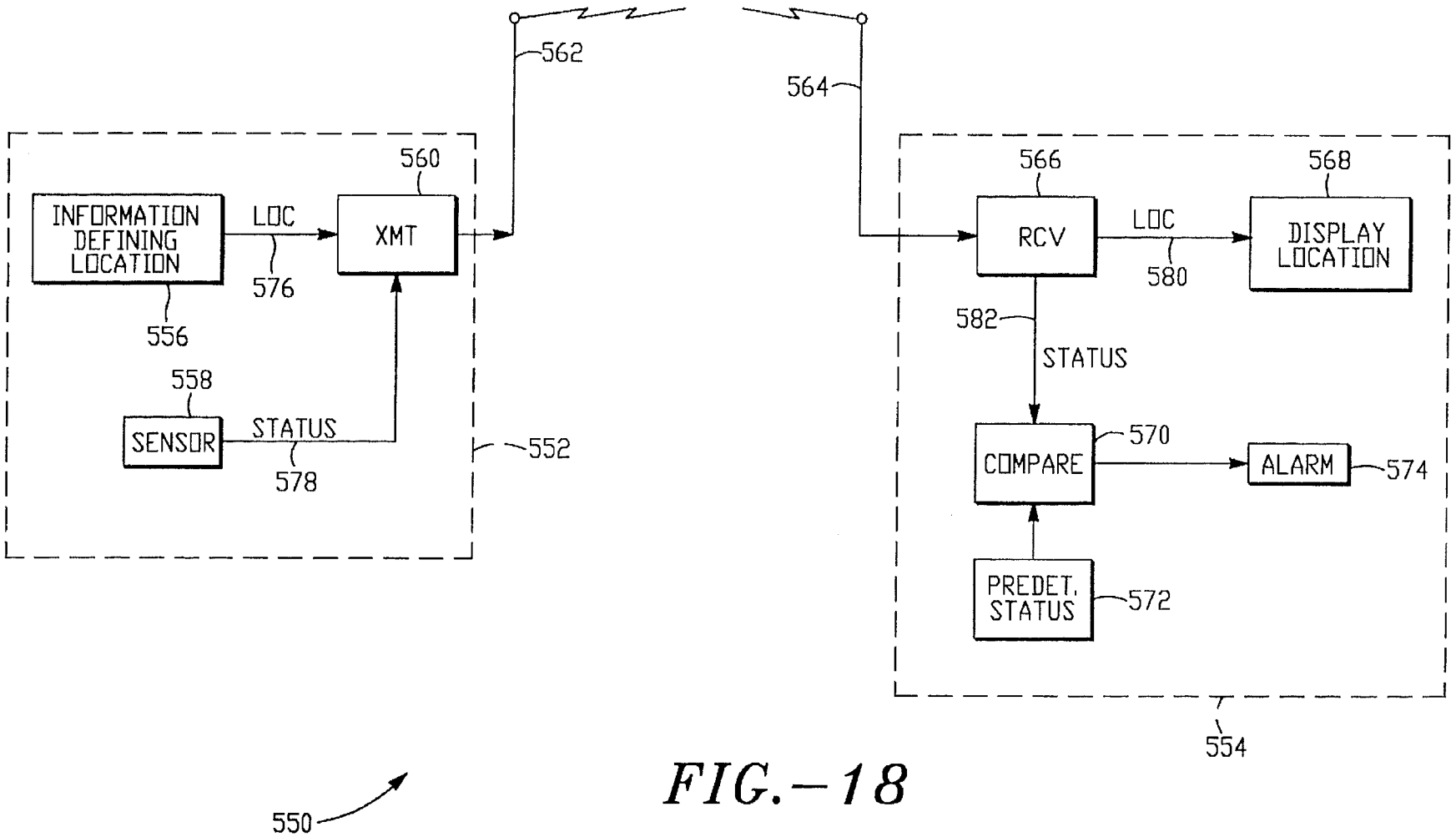
FIG. 18 is a block diagram showing a fixed-location environmental sensing system according to another aspect of the present invention.

FIG. 18 is a block diagram showing an environmental monitoring system for use in fixed locations, designated generally by the numeral 550. The environmental monitoring system 550 includes a remote unit 552 and a base station 554.

The remote unit 552 includes storage circuits 556 for storing information defining the location of the remote unit 552, at least one sensor 558, a radio transmitter 560, and an antenna 562.

The base station 554 includes an antenna 564, a radio receiver 566, a display 568 for displaying the location of the remote unit 552, a comparator 570, storage circuits 572 for storing information defining a predetermined sensor status, and an alarm 574.

The environmental monitoring system 550 is useful for applications in which the remote unit 552 remains in a fixed location which can be loaded into the storage circuits 556 when the remote unit 552 is activated. Such applications would include use in forests for fire perimeter monitoring in which the sensor 558 was a heat sensor, or in monitoring for oil spills when attached to a fixed buoy and the sensor 558 detecting oil. Other useful applications include any application in which the location is known at the time of activation and in which some physical parameter is to be measured or detected, such as smoke, motion, and mechanical stress. The environmental monitoring system 550 offers an alternative to pre-assigned remote unit ID numbers, such as those used in the systems illustrated in FIGS. 2 and 3.

The storage circuits 556 provide an output 576 defining the location of the remote unit 552. This output is connected to the radio transmitter 560 for communication with the base station 554. The sensor 558 provides an output signal 578 defining a sensor status. The output signal is connected to the radio transmitter 560 for communication of the sensor status to the base station 554.

The communications are received by the base station's radio receiver 566 which provides outputs representing both the location 580 of the remote unit 552 and the sensor status 582. The location 580 is connected to the display 568 so that the location of the remote unit 552 can be displayed. The comparator 570 receives the sensor status 582 and the information defining the predetermined sensor status which is stored in the storage circuits 572. If the comparator 570 determines that the sensor status indicates an alarm situation, it activates the alarm 574 to alert a base station operator.

Figure 19:
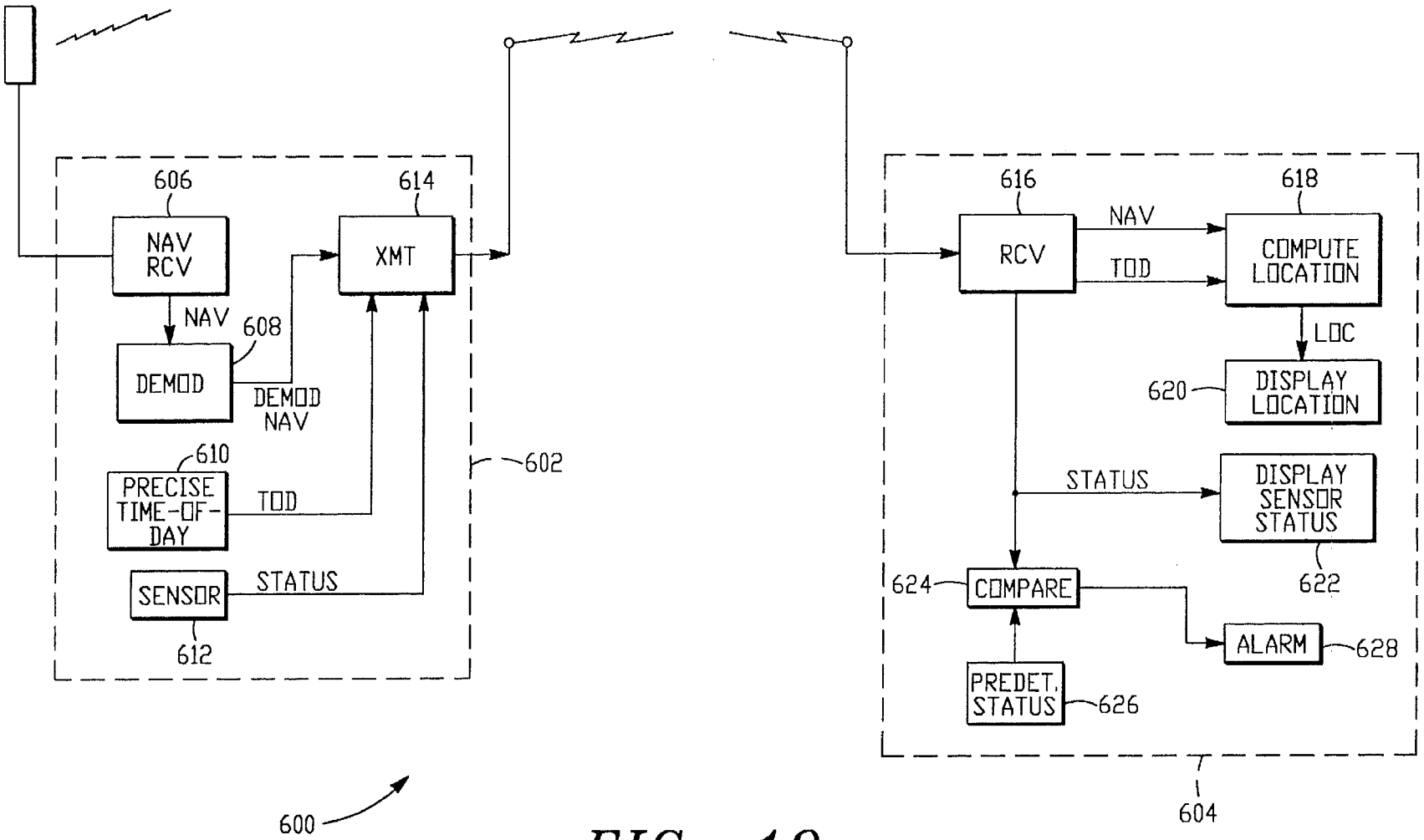
FIG. 19 is a block diagram of a personal alarm system including navigational location in which the geometric dilution of precision calculations are done at the base station.

FIG. 19 is a block diagram which illustrates an alternative embodiment of a personal alarm system in which the remote unit transmits demodulated navigational and precise time-of-day information to the base station, and the base station uses that information to compute the location of the remote unit. This alternative embodiment is designated generally by the numeral 600 and includes a remote unit 602 and a base station 604.

The remote unit 602 includes a navigational receiver 606, a demodulator circuit 608, a precise time-of-day circuit 610, a sensor 612, and a radio transmitter 614.

The base station 604 includes a radio receiver 616, computational circuits 618 for computing the location of the remote unit 602, a display 620 for displaying the computed location, a second display (can be part of the first display) 622 for displaying a sensor status, a comparator 624, storage circuits 626 for storing information defining a predetermined sensor status, and an alarm 628.

In a preferred embodiment, the navigational receiver 606 receives navigational information from global positioning system satellites (not shown). In this embodiment, the raw navigational information is demodulated by the demodulator circuit 608 and the output of the demodulator 608 is connected to the radio transmitter 614 for communication to the base station 604.

The precise time-of-day circuits 610 provide the time-of-day information needed to compute the actual location of the remote unit based upon the demodulated navigational information. In the case of GPS navigational information, geometric dilution of precision computations are done at the base station 604 to derive the actual location of the remote unit 602.

The sensor 612 provides an output signal defining a sensor status. The demodulated navigational information, the precise time-of-day information and the sensor status are all connected to the radio transmitter 614 for communication to the base station 604.

At the base station 604, the radio receiver 616 provides the navigational and precise time-of-day information to the computation circuits 618 for determining the actual location. In a preferred embodiment, the computation is made using an embedded microprocessor. The computed location is displayed using the display 620.

The radio receiver 616 also provides the received sensor status which forms one input to the comparator 624. Stored information defining a predetermined sensor status is provides by the storage circuits 626 as a second input to the comparator 624. If the received sensor status and the stored sensor status do not agree, the comparator 624 activates the alarm 628 to alert the base station operator.

Figure 20:
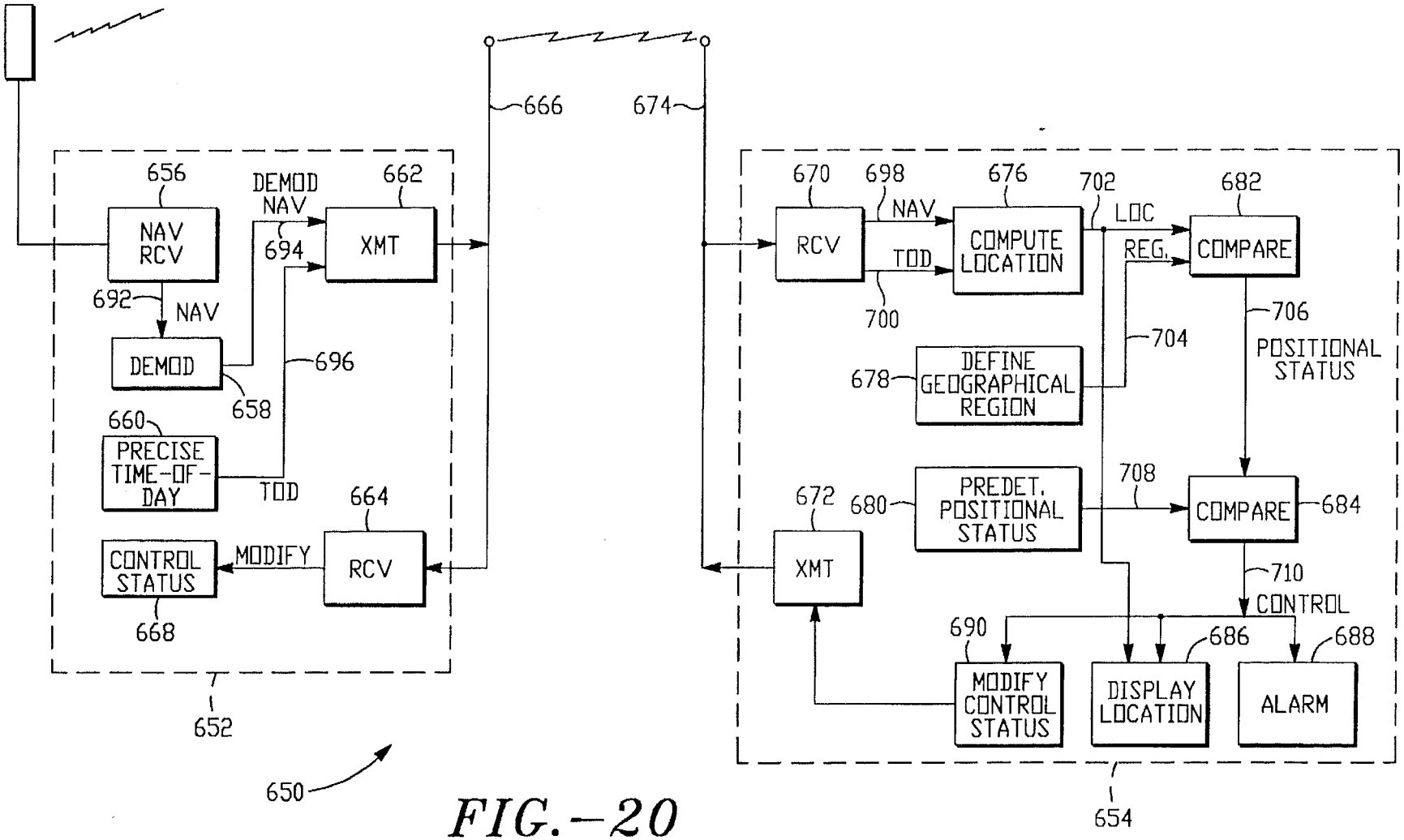
FIG. 20 is a block diagram showing another embodiment of an invisible fence system.

FIG. 20 is a block diagram which illustrates an alternative embodiment of the invisible fence system in which the base station computes the location of the remote unit, and in which the fence definitions are stored at the base station rather than in the remote unit. The alternative system is designated generally by the numeral 650 and includes a remote unit 652 and a base station 654.

The remote unit 652 includes a navigational receiver 656, a demodulator circuit 658, a precise time-of-day circuit 660, a radio transmitter 662, a radio receiver 664, a shared antenna 666, and control status circuits 668.

The base station 654 includes a radio receiver 670, a radio transmitter 672, a shared antenna 674, computation circuits 676, storage circuits 678, second storage circuits 680, a first comparator 682, a second comparator 684, a display 686, an alarm 688, and control circuits 690.

The navigational receiver 656 provides raw navigational information 692 to the demodulator circuit 658. The demodulator circuit 658 demodulates the raw navigational information and provides demodulated navigational information 694 to the radio transmitter 662 for communication to the base station 654. The precise time-of-day circuit 660 provides time-of-day information 696 to the radio transmitter 662 for communication to the base station 654.

The base station radio receiver 670 provides received navigational information 698 and received time-of-day information 700 to the computation circuits 676 for conversion to an actual location 702 of the remote unit 652. The storage circuits 678 store information defining a geographical region.

The first comparator 682 receives the location 702 and the region defining information 704 and provides a positional status 706, as described above with respect to FIGS. 13–16.

The second storage circuits 680 store information 708 defining a predetermined positional status. The second comparator 684 receives the positional status 706 and the predetermined positional status 708 and provides control output signals 710 based upon the results of the positional status comparison. When the location 702 is within a defined "warning" or "restricted" zone, the second comparator 684 activates the alarm 688 and causes the location 702 to be displayed by the display 686.

In one preferred embodiment, the remote unit includes circuits 668 which provide a means by which the base station 654 can warn the remote unit user or enforce a restriction, as for example, by applying the mild electric shock of the embodiment shown in FIG. 13. The second comparator 684 uses a control signal 710 to activate the control circuits 690 to send a command via the radio transmitter 672 to the remote unit 652 for modifying the remote unit control status. For example, if the remote unit location is within a restricted zone, the base station 654 will command the remote unit 652 to provide an electric shock to enforce the restriction.

While the foregoing detailed description has described several embodiments of the personal alarm system in accordance with this invention, it is to be understood that the above description is illustrative only and not limiting of the disclosed invention. Thus, the invention is to be limited only by the claims as set forth below.

What is claimed is:

1. A man-over-board alarm system, comprising:

a remote unit including a navigational receiver for receiving navigational information defining a location of the remote unit, and a radio transmitter for transmitting the remote unit location;

a base station including a radio receiver for receiving the remote unit location;

the remote unit and the base station defining a separation distance between the remote unit and the base station; and the base station including measuring means for determining whether the separation distance exceeds a predetermined limit, and means responsive to the measuring means for giving an alarm and a display for displaying the remote unit location, whereby, a separation distance exceeding the predetermined limit causes a man-over-board alarm and the base station displays the location of the remote unit.

2. The man-over-board system as set forth in claim 1, wherein the navigational information is received from global positioning system satellites.

3. The man-over-board system as set forth in claim 1, wherein the remote unit further includes a sensor having an output signal, the sensor defining a sensor status, and the radio transmitter connected to the output signal for transmitting the sensor status, and the base station including a display for displaying the sensor status.

4. The man-over-board system as set forth in claim 3, wherein the sensor detects immersion in water.

5. The man-over-board system as set forth in claim 3, wherein the sensor output signal is provided by a remote unit manually operated switch, and defines a panic button.

6. The man-over-board system as set forth in claim 3, wherein the remote unit is battery operated and includes a low-battery-power circuit for providing the sensor output signal.

7. The man-over-board system as set forth in claim 1, wherein the base station includes a radio transmitter and the remote unit includes a radio receiver defining two-way radio communication between the remote unit and the base station.

8. The man-over-board system as set forth in claim 7, wherein the base station transmits a control signal to the remote unit for initiating a beacon for use in locating the remote unit.

9. The man-over-board system as set forth in claim 8, wherein the beacon is a light source.

10. The man-over-board system as set forth in claim 8, wherein the beacon is an audible source.

11. The man-over-board system as set forth in claim 8, wherein the remote radio transmitter is able to transmit at more than one power level and the beacon defines a higher power level.

12. An invisible fence system for monitoring a movable subject, comprising:

a remote unit including, a navigational receiver for receiving navigational information defining a location of the remote unit, means for storing information defining a geographical region, means for comparing the location of the remote unit with the defined geographical region and determining a positional status, the status defining a relation between the location of the remote unit and the defined geographical region, and a radio transmitter for transmitting the positional status; and a base station including, a radio receiver for receiving the positional status, means for providing an alarm responsive to a predetermined change in the positional status, whereby the remote unit is attached to the monitored subject and its location in relation to the defined geographical region provides an alarm responsive to a predetermined change in the relation.

13. The invisible fence system as set forth in claim 12, wherein the navigational information is received from global positioning system satellites.

14. The invisible fence system as set forth in claim 12, wherein the defined geographical region has at least one boundary and is defined in terms of the at least one boundary.

15. The invisible fence system as set forth in claim 12, wherein the defined geographical region includes defined subdivisions, and the positional status indicates a remote unit location relative to the defined subdivisions.

16. The invisible fence system as set forth in claim 15, wherein a first subdivision defines a warning zone, and a second subdivision defines a punishment zone, and wherein the remote unit includes alarm means responsive to a location within the warning zone, and also includes means for applying a mild electric shock to the monitored subject responsive to a location within the punishment zone.

17. The invisible fence system as set forth in claim 12, wherein the base station includes a radio transmitter and the remote unit includes a radio receiver, the remote unit and the base station defining a two-way communications link.

18. The invisible fence system as set forth in claim 17, wherein the two-way communications link further includes access to a cellular telephone network for completing the two-way link.

19. The invisible fence system as set forth in claim 17, wherein the two-way communications link further includes access to a wireless communications network for completing the two-way link.

20. The invisible fence system as set forth in claim 17, wherein the two-way communications link further includes access to a radio relay network for completing the two-way link.

21. A stationary environmental monitor, comprising:

a remote unit including, storage means for storing information defining the location of the remote unit, an environmental sensor providing an output signal and defining a sensor status, a radio transmitter connected for transmission of the location defining information and the sensor status, and a radio receiver;

a base station including, a radio receiver for receiving the location defining information and the sensor status, a radio transmitter, and means responsive to a predetermined change in the sensor status for displaying the location of the remote unit and providing an alarm; and the remote unit and the base station defining a two-way communications link, whereby the location of the remote unit is stored in the storage means and a change in the sensor status causes the location to be displayed and an alarm given at the base station.

22. The stationary environmental monitor as set forth in claim 21, wherein the two-way communications link further includes access to a cellular telephone network for completing the two-way link.

23. The stationary environmental monitor as set forth in claim 21, wherein the two-way communications link further includes access to a wireless communications network for completing the two-way link.

24. The stationary environmental monitor as set forth in claim 21, wherein the two-way communications link further includes access to a radio relay network for completing the two-way link.

25. A personal alarm system, comprising:

a remote unit including a radio transmitter and a radio receiver, the remote unit capable of transmitting at more than one power level, and defining a higher power level;

a base station including a radio receiver and a radio transmitter;

the remote unit and the base station defining a two-way communication link;

the remote unit including at least one hazard sensor providing an output signal and defining a sensor status;

the remote unit radio transmitter being connected to the at least one sensor output signal for communicating the sensor status to the base station;

the base station including means responsive to the sensor status for giving an alarm when a hazard is detected; and the base station transmits at predetermined intervals, and the remote unit transmitter switches to the higher power level if a base station transmission is not received within an interval slightly longer than the predetermined interval.

26. A personal alarm system, comprising:

a remote unit including a navigational receiver for receiving navigational information, a demodulator for demodulating the received navigational information, timing circuits for providing precise time-of-day information, a sensor for detecting a personal hazard, the sensor having an output signal and defining a sensor status, and a radio transmitter for transmitting the demodulated navigational information, the precise time-of-day information, and the sensor status;

a base station including a radio receiver for receiving the demodulated navigational information, the precise time-of-day information, and the sensor status;

the base station also including computational means connected for combining the received demodulated navigational information and the precise time-of-day information to determine a location of the remote unit, and a first display for displaying the location of the remote unit; and the base station also including a second display for displaying the sensor status and means responsive to a change in the sensor status for giving an alarm, whereby, a change in the sensor status sounds an alarm and the remote unit location is displayed.

27. The personal alarm system as set forth in claim 26, further including:

the base station having a radio transmitter; and the remote unit having a radio receiver and defining a two-way radio link with the base station.

28. A personal alarm system as set forth in claim 27, wherein the two-way communications link further includes access to a cellular telephone network for completing the two-way link.

29. The personal alarm system as set forth in claim 27, wherein the two-way communications link further includes access to a wireless communications network for completing the two-way link.

30. The personal alarm system as set forth in claim 27, wherein the two-way communications link further includes access to a radio relay network for completing the two-way link.

31. The personal alarm system as set forth in claim 26, wherein the sensor also includes a manually operated switch providing the output signal and defining a panic button, and the means for giving an alarm is responsive to the panic button.

32. A personal alarm system, comprising:

a remote unit including, a navigational receiver for receiving navigational information, a demodulator for demodulating the received navigational information, timing circuits for providing precise time-of-day information, and a radio transmitter for transmitting the demodulated navigational information and the precise time-of-day information; and a base station including, a receiver for receiving the demodulated navigational information and the precise time-of-day information, computational means connected for combining the demodulated navigational information and the precise time-of-day information to determine a location of the remote unit, means for storing information defining a geographical region, means for comparing the computed location with the defined geographical region and determining a positional status, the status defining a relation between the location of the remote unit and the defined geographical region, and means for displaying the location of the remote unit in response to a predetermined positional status.

33. The personal alarm system as set forth in claim 32, further including an alarm responsive to a predetermined positional status.

34. The personal alarm system as set forth in claim 32, further including:

the base station having a radio transmitter, and the remote unit having a radio receiver and defining a two-way communications link with the base station.

35. The personal alarm system as set forth in claim 34, further including:

the base station having means responsive to a predetermined positional status for transmitting a command to the remote unit; and the remote defining a control status and having means responsive to a received command for modifying the control status.

36. The personal alarm system as set forth in claim 34, wherein the two-way communications link further includes access to a cellular telephone network for completing the two-way link.

37. The personal alarm system as set forth in claim 34, wherein the two-way communications link further includes access to a wireless communications network for completing the two-way link.

38. The personal alarm system as set forth in claim 34, wherein the two-way communications link further includes access to a radio relay network for completing the two-way link.

39. A personal alarm system, comprising:

a remote unit including a navigational receiver for receiving navigational information defining a location of the remote unit, a sensor for detecting a personal hazard, the sensor having an output signal and defining a sensor status, and a radio transmitter for transmitting the remote unit location and the sensor status;

a base station including a radio receiver for receiving the remote unit location and the sensor status;

the base station also including a display for displaying the remote unit location and the sensor status; and the base station also including means responsive to a change in the sensor status for giving an alarm, whereby, the remote unit location is displayed and a change in the sensor status produces an alarm.

40. The personal alarm system as set forth in claim 39, further including:

the base station having a radio transmitter; and the remote unit having a radio receiver and defining a two-way radio link with the base station.

41. A personal alarm system as set forth in claim 40, wherein the two-way communications link further includes access to a cellular telephone network for completing the two-way link.

42. The personal alarm system as set forth in claim 40, wherein the two-way communications link further includes access to a wireless communications network for completing the two-way link.

43. The personal alarm system as set forth in claim 40, wherein the two-way communications link further includes access to a radio relay network for completing the two-way link.

44. The personal alarm system as set forth in claim 39, wherein the sensor also includes a manually operated switch providing the output signal and defining a panic button, and the means for giving an alarm is responsive to the panic button.

45. A personal alarm system, comprising:

a remote unit including, a navigational receiver for receiving navigational information, a demodulator for demodulating the received navigational information, timing circuits providing precise time-of-day information, computational means connected for combining the demodulated navigational information and the precise time-of-day information to determine a location of the remote unit, means for storing information defining a geographical region, means for comparing the computed location with the defined geographical region and determining a positional status, the status defining a relation between the computed location of the remote unit and the defined geographical region, and a radio transmitter for transmitting the positional status;

a base station including, a radio receiver for receiving the positional status, means for providing an alarm responsive to a change in the positional status.

46. The personal alarm system as set forth in claim 45, further including:

the base station having a radio transmitter; and the remote unit having a radio receiver and defining a two-way radio link with the base station.

47. A personal alarm system as set forth in claim 46, wherein the two-way communications link further includes access to a cellular telephone network for completing the two-way link.

48. The personal alarm system as set forth in claim 46, wherein the two-way communications link further includes access to a wireless communications network for completing the two-way link.

49. The personal alarm system as set forth in claim 46, wherein the two-way communications link further includes access to a radio relay network for completing the two-way link.

50. A personal alarm system, comprising:

a remote unit including, a navigational receiver for receiving navigational information defining a location of the remote unit, means for storing information defining a geographical region, means for comparing the location of the remote unit with the defined geographical region and determining a positional status, the status defining a relation between the location of the remote unit and the defined geographical region, and a radio transmitter for transmitting the positional status;

a base station including, a radio receiver for receiving the positional status, means for providing an alarm responsive to a change in the positional status.

51. The personal alarm system as set forth in claim 50, further including:

the base station having a radio transmitter; and the remote unit having a radio receiver and defining a two-way radio link with the base station.

52. A personal alarm system as set forth in claim 51, wherein the two-way communications link further includes access to a cellular telephone network for completing the two-way link.

53. The personal alarm system as set forth in claim 51, wherein the two-way communications link further includes access to a wireless communications network for completing the two-way link.

54. The personal alarm system as set forth in claim 51, wherein the two-way communications link further includes access to a radio relay network for completing the two-way link.

55. A personal alarm system remote unit comprising:

a navigational receiver for providing a location of the remote unit;

at least one manually operated switch having an output, the at least one switch defining a panic button; and a radio transmitter connected for receiving the remote unit location, the at least one switch output, defining a switch status, and transmitting the remote unit location and the switch status.

56. The personal alarm system remote unit as set forth in claim 55, further comprising:

an identification circuit for providing a remote unit identification code; and the radio transmitter being adapted for transmitting the identification code.

57. The personal alarm system remote unit as set forth in claim 55, further comprising:

the radio transmitter being adapted for transmission at more than one power level;

a power level selection circuit connected for selecting the transmission power level of the radio transmitter, the selection circuit being responsive to the at least one switch for selecting a transmission power level.

58. The personal alarm system remote unit as set forth in claim 55, further comprising:

a radio receiver for receiving a command; and a beacon responsive to the received command.

59. The personal alarm system remote unit as set forth in claim 58, further comprising:

the beacon being a visual beacon.

60. The personal alarm system remote unit as set forth in claim 58, further comprising:

the beacon being an audible beacon.

61. The personal alarm system remote unit as set forth in claim 55, further comprising:

a radio receiver for receiving a command; and the transmission power level selection circuit being responsive to the received command for selecting the transmission power level.

62. A personal alarm system remote unit, comprising:

a navigational receiver for providing a location of the remote unit;

a sensor having at least one output signal and defining a sensor status; and a radio transmitter connected for transmitting the remote unit location and the sensor status.

63. The personal alarm system remote unit as set forth in claim 62, wherein the sensor further comprises a manually operated switch defining a pair of electrical contacts for providing the at least one output signal.

* * * * *